US011225897B2

(12) United States Patent
Baumgartner et al.

(10) Patent No.: US 11,225,897 B2
(45) Date of Patent: Jan. 18, 2022

(54) VEHICLE EXHAUST SYSTEM

(71) Applicant: Tenneco Automotive Operating Company Inc., Lake Forest, IL (US)

(72) Inventors: Frederick Michael Baumgartner, Jackson, MI (US); Garrick Robert Zuver, Brooklyn, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 243 days.

(21) Appl. No.: 16/519,408

(22) Filed: Jul. 23, 2019

(65) Prior Publication Data

US 2019/0360375 A1 Nov. 28, 2019

(51) Int. Cl.
*F01N 13/08* (2010.01)
*F01N 1/24* (2006.01)

(52) U.S. Cl.
CPC ..... *F01N 13/08* (2013.01); *F01N 1/24* (2013.01); *F01N 2470/04* (2013.01)

(58) Field of Classification Search
CPC . F01N 1/14; F01N 3/30; F01N 13/082; F01N 2260/18; F01N 2270/06; F01N 2270/08; F01N 2470/04
See application file for complete search history.

(56) References Cited

U.S. PATENT DOCUMENTS 2,943,695 A * 7/1960 Jeffords ..... B25D 17/12 181/243
4,164,989 A 8/1979 Lux et al.
4,371,053 A * 2/1983 Jones ..... F01N 1/02 181/249
4,537,277 A 8/1985 Bryce
4,842,096 A 6/1989 Fujitsubo
6,109,387 A 8/2000 Boretti
(Continued)

FOREIGN PATENT DOCUMENTS

CN 206016934 U 3/2017
CN 108331638 A 7/2018
(Continued)

OTHER PUBLICATIONS

PCT Search Report and Written Opinion of the International Searching Authority for Counterpart PCT/US2020/042727, dated Oct. 30, 2020.

*Primary Examiner* — Jonathan R Matthias
(74) *Attorney, Agent, or Firm* — McGarry Bair PC

(57) ABSTRACT

A vehicle exhaust system includes a tubular component having an inner surface and an outer surface such that the inner surface defines a primary exhaust gas flow path. The tubular component extends along a central axis from an inlet end to an outlet end. The tubular component includes at least one ridge extending at least partly along a circumference of the tubular component. The at least one ridge includes a first portion angularly extending inwardly from the tubular component, and a second portion disposed downstream of the first portion. The second portion angularly extends inwardly from the tubular component. In some cases, the second portion defines a plurality of openings extending therethrough and spaced apart from each other. In some cases, the tubular component defines a plurality of tube openings disposed downstream of the at least one ridge.

20 Claims, 20 Drawing Sheets

(56) References Cited

U.S. PATENT DOCUMENTS

| | | | | |
|---|---|---|---|---|
| 6,385,967 | B1 * | 5/2002 | Chen | F01N 1/023 181/252 |
| 7,174,991 | B1 | 2/2007 | Gunnarsson et al. | |
| 7,455,498 | B2 | 11/2008 | Zysman | |
| 7,918,310 | B1 | 4/2011 | Helgeson et al. | |
| 8,162,103 | B2 | 4/2012 | Barrieu et al. | |
| 8,439,159 | B1 * | 5/2013 | Borla | F01N 1/083 181/257 |
| 8,539,761 | B2 | 9/2013 | Lebas et al. | |
| 8,881,863 | B2 | 11/2014 | Abram et al. | |
| 8,931,284 | B2 | 1/2015 | Hussain et al. | |
| 9,970,340 | B2 | 5/2018 | Abram et al. | |
| 10,047,650 | B2 | 8/2018 | Abram | |
| 2004/0104071 | A1 * | 6/2004 | Wahlstrom | F01N 13/08 181/248 |
| 2008/0017444 | A1 | 1/2008 | Dowdy | |
| 2009/0045006 | A1 | 2/2009 | Kondo et al. | |
| 2012/0138383 | A1 | 6/2012 | Murata et al. | |
| 2019/0360375 | A1 | 11/2019 | Baumgartner et al. | |

FOREIGN PATENT DOCUMENTS

| | | | |
|---|---|---|---|
| CN | 207673411 | U | 7/2018 |
| DE | 102005053356 | A1 | 3/2016 |
| KR | 101928556 | B1 | 12/2018 |

* cited by examiner

VEHICLE EXHAUST SYSTEM

TECHNICAL FIELD

The present disclosure relates to a vehicle exhaust system. More specifically, the present disclosure relates to damping of sound generated by the vehicle exhaust system.

BACKGROUND

A vehicle exhaust system directs exhaust gas generated by an internal combustion engine to external environment. The exhaust system may include various components, such as pipes, converters, catalysts, filters, and the like. During operation of the exhaust system, as a result of resonating frequencies, the components may generate undesirable noise. Different methods have been employed in various applications to address this issue.

For example, the components, such as mufflers, resonators, valves, and the like, have been incorporated into the exhaust system to attenuate certain resonance frequencies generated by the engine or the exhaust system. However, such additional components are expensive and increase weight of the exhaust system. Also, adding new components into the exhaust system may introduce new sources of undesirable noise generation.

A sound attenuating method is a Standing Wave Management (SWM) technology. The SWM includes an opening provided on an exhaust pipe. The opening provides a secondary exhaust leak path for sound to exit the exhaust pipe and minimizes leakage of the exhaust gas through the opening. The SWM utilizes a series of holes to allow sound waves to exit the exhaust pipe while limiting leakage of the exhaust gas. In some instances, the holes may be covered with a microperforated material. In order to achieve a desired noise attenuation, the holes have to be relatively large in size.

However, the microperforated material is very thin and is not as structurally sound as a solid pipe wall of the exhaust pipe. As such, creating holes in the microperforated material may adversely affect durability of the microperforated material. Additionally, if relatively larger holes are cut into the exhaust pipe and covered with the microperforated material, durability of the exhaust pipe may also be adversely affected. Another concern is with grazing flow that may occur across a surface of the microperforated material. The acoustic properties of the microperforated material may change when the exhaust gas flows across the surface of the microperforated material. This may often reduce an ability of an acoustic wave to propagate through the micro perforations, which may limit the damping effect.

SUMMARY

In an aspect of the present disclosure, a vehicle exhaust system is provided. The vehicle exhaust system includes a tubular component having an inner surface and an outer surface such that the inner surface defines a primary exhaust gas flow path. The tubular component extends along a central axis from an inlet end to an outlet end. The tubular component includes a plurality of ridges spaced apart from each other relative to the central axis of the tubular component. Each ridge extends at least partly along a circumference of the tubular component. Each ridge includes a first portion angularly extending inwardly from the tubular component, and a second portion disposed downstream of the first portion. The second portion angularly extends inwardly from the tubular component. The second portion defines a plurality of openings extending therethrough and spaced apart from each other.

In another aspect of the present disclosure, a vehicle exhaust system is provided. The vehicle exhaust system includes one or more exhaust components fluidly coupled to an engine, and a tubular component provided in fluid communication with the one or more exhaust components. The tubular component has an inner surface and an outer surface such that the inner surface defines a primary exhaust gas flow path. The tubular component extends along a central axis from an inlet end to an outlet end. The tubular component includes a plurality of ridges spaced apart from each other relative to the central axis of the tubular component. Each ridge extends at least partly along a circumference of the tubular component. Each ridge includes a first portion angularly extending inwardly from the tubular component, and a second portion disposed adjacent to and downstream of the first portion. The second portion angularly extends inwardly from the tubular component. The second portion defines a plurality of openings extending therethrough and spaced apart from each other.

In yet another aspect of the present disclosure, a vehicle exhaust system is provided. The vehicle exhaust system includes a tubular component having an inner surface and an outer surface such that the inner surface defines a primary exhaust gas flow path. The tubular component extends along a central axis from an inlet end to an outlet end. The tubular component includes at least one ridge extending at least partly along a circumference of the tubular component. The at least one ridge includes a first portion angularly extending inwardly from the tubular component, and a second portion disposed downstream of the first portion. The second portion angularly extends inwardly from the tubular component. The tubular component further defines a plurality of tube openings extending therethrough and disposed downstream of the at least one ridge.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

Figure 1:
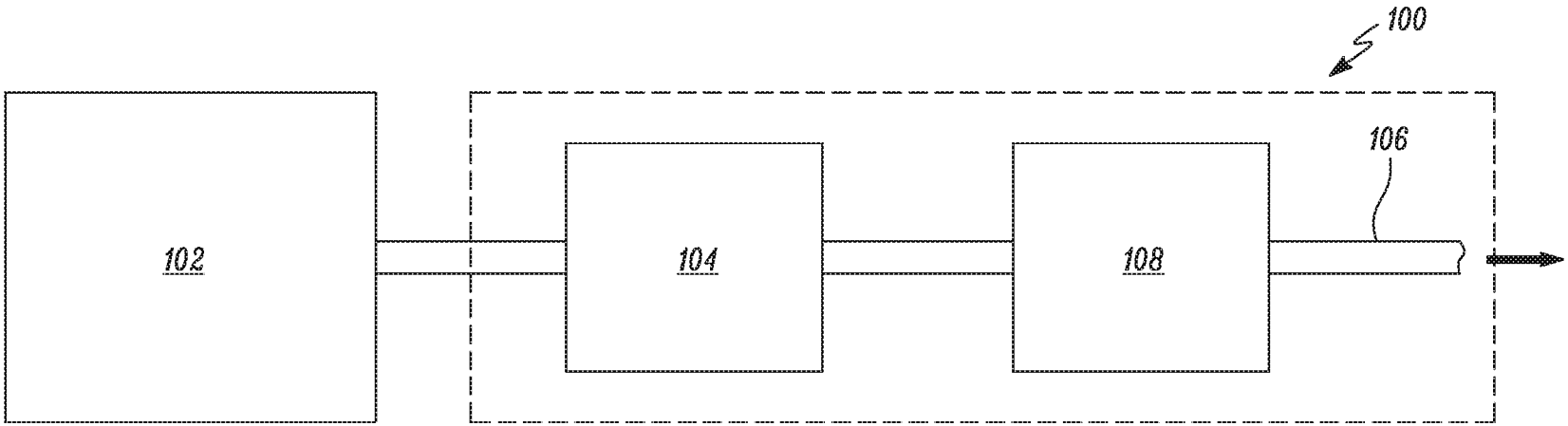
FIG. 1 is a schematic representation of a vehicle exhaust system, according to an aspect of the present disclosure.

The following description of the preferred embodiment(s) is merely exemplary in nature and is in no way intended to limit the invention, its application, or uses. Referring now to the drawings in which like reference numerals designate like or corresponding parts throughout the several views, there is shown in FIG. 1. Referring to FIG. 1, a schematic representation of a vehicle exhaust system 100 is illustrated. The vehicle exhaust system 100 will be hereinafter interchangeably referred to as the "system 100". The system 100 is fluidly coupled to an engine 102. The engine 102 may be any internal combustion engine powered by a fuel, such as diesel, gasoline, natural gas, and/or a combination thereof. Accordingly, the system 100 receives exhaust gas generated by the engine 102.

The system 100 includes a number of downstream exhaust components 104 fluidly coupled to the engine 102. The exhaust components 104 may include a number of systems/components (not shown), such as a Diesel Oxidation Catalyst (DOC), a Diesel Exhaust Fluid (DEF) unit, a Selective Catalytic Reduction (SCR) unit, a particulate filter, an exhaust pipe, an active valve, a passive valve and the like. The exhaust components 104 may be mounted in various different configurations and combinations based on application requirements and/or available packaging space. The exhaust components 104 are adapted to receive the exhaust gas from the engine 102 and direct the exhaust gas to the external atmosphere via a tailpipe 106. The exhaust components 104 are adapted to reduce emissions and control noise.

The system 100 also includes an exhaust member 108. In some embodiments, the exhaust member 108 may be part of an exhaust pipe. The exhaust member 108 may perform noise attenuation. The exhaust member 108 is provided in fluid communication with the exhaust components 104 and the tailpipe 106. In the illustrated embodiment, the exhaust member 108 is disposed downstream of the exhaust components 104 and upstream of the tailpipe 106. In other embodiments, the exhaust member 108 may be disposed in any sequence with respect to each of the exhaust components 104 and/or the tailpipe 106, based on application requirements. The exhaust member 108 is adapted to dampen resonance frequencies generated during operation of the engine 102 and the system 100.

Figure 2:
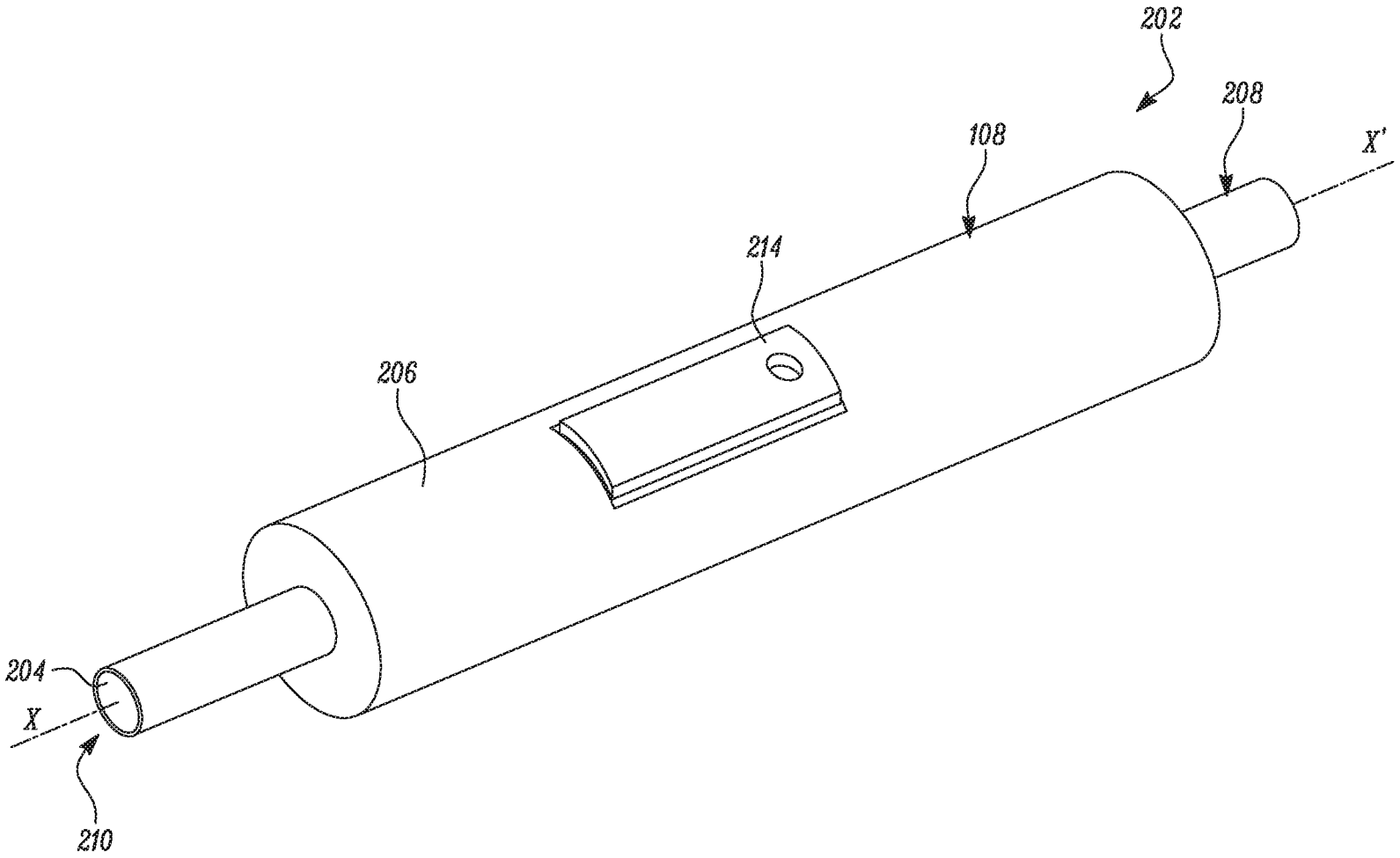
FIG. 2 is a perspective view of a tubular component of the vehicle exhaust system of FIG. 1, according to an aspect of the present disclosure.

Referring to FIG. 2, a perspective view of an exemplary tubular component 202 associated with the system 100 is illustrated. In the illustrated embodiment, the tubular component 202 is the exhaust member 108. In other embodiments, the tubular component 202 may be any one or more of the exhaust components 104 and/or any portion of the system 100, such as the exhaust pipe, the tailpipe 106, and the like. The tubular component 202 has a substantially hollow and cylindrical configuration defining a central axis X-X'. Accordingly, the tubular component 202 includes an inner surface 204 and an outer surface 206. The tubular component 202 also includes an inlet end 208 and an outlet end 210. The outlet end 210 is disposed opposite and spaced apart with respect to the inlet end 208 along the central axis X-X'. The tubular component 202 defines a primary exhaust gas flow path along the inner surface 204 between the inlet end 208 and the outlet end 210 along the central axis X-X'.

The tubular component 202 also includes an opening 212 (shown in FIG. 3 to FIG. 6). In the illustrated embodiment, the tubular component 202 includes a single opening 212. In other embodiments, the tubular component 202 may include multiple openings, based on application requirements. The opening 212 extends through each of the inner surface 204 and the outer surface 206. In the illustrated embodiment, the opening 212 has a substantially rectangular configuration. In other embodiments, the opening 212 may have any other configuration, such as circular, triangular, elliptical, and the like. The opening 212 provides a secondary exhaust gas flow path in association with the primary exhaust gas flow path.

Figure 3:
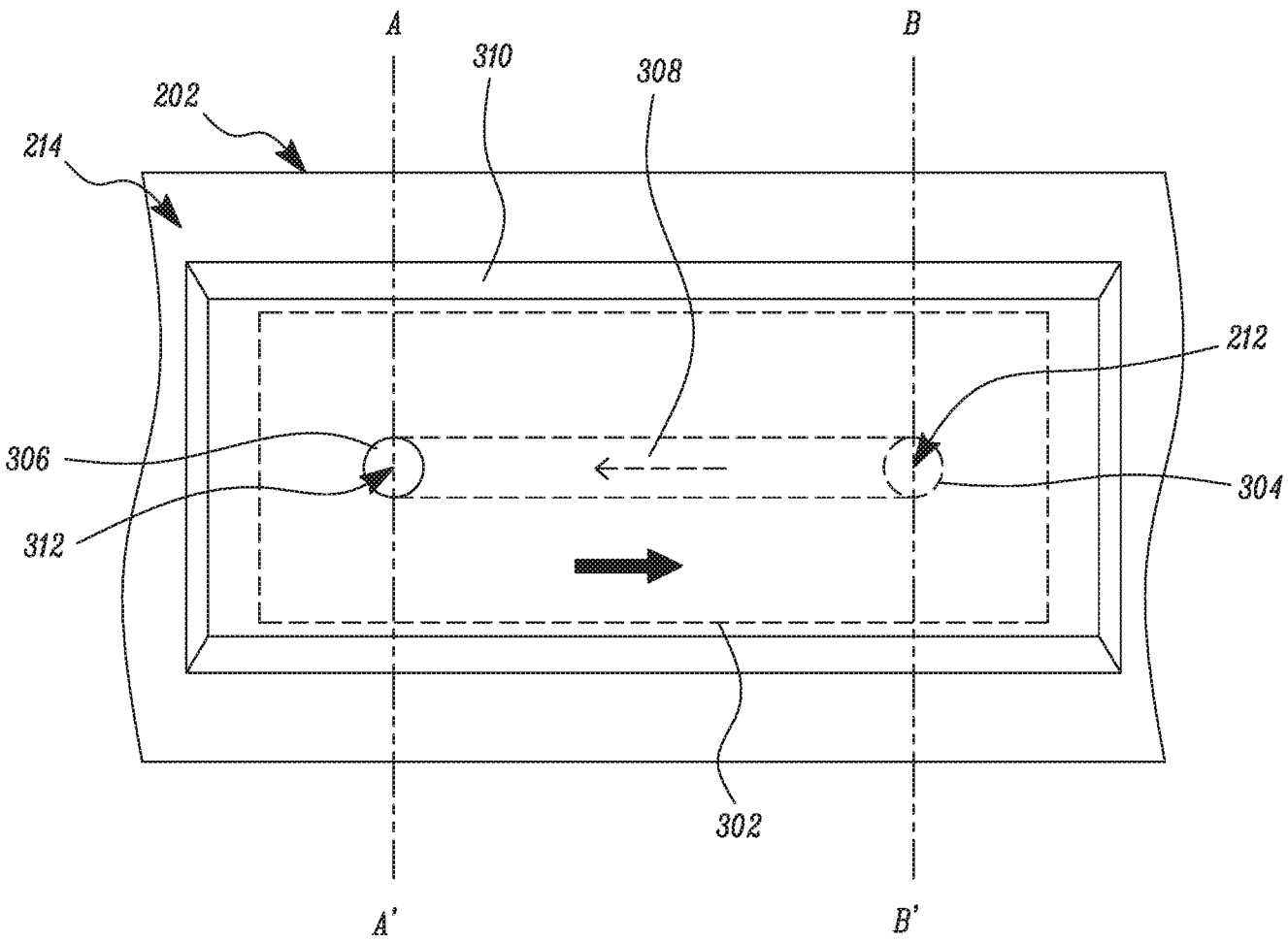
FIG. 3 is a front view of a patch for the tubular component of FIG. 2, according to an aspect of the present disclosure.

The system 100 also includes a patch 214 coupled to the tubular component 202. More specifically, the patch 214 is disposed adjacent to the opening 212 in order to cover the opening 212. Referring to FIG. 3, a front view of an embodiment of the patch 214 is illustrated. The patch 214 may have any suitable structural configuration, based on the configuration of the opening 212.

Figure 4B:
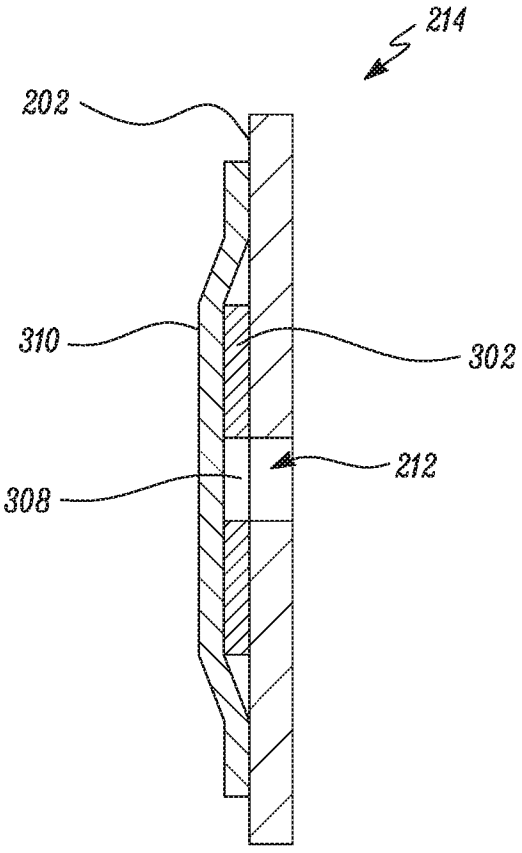
FIG. 4B is a cross sectional view of the patch of FIG. 3 along a section B-B', according to an aspect of the present disclosure.
Figure 4A:
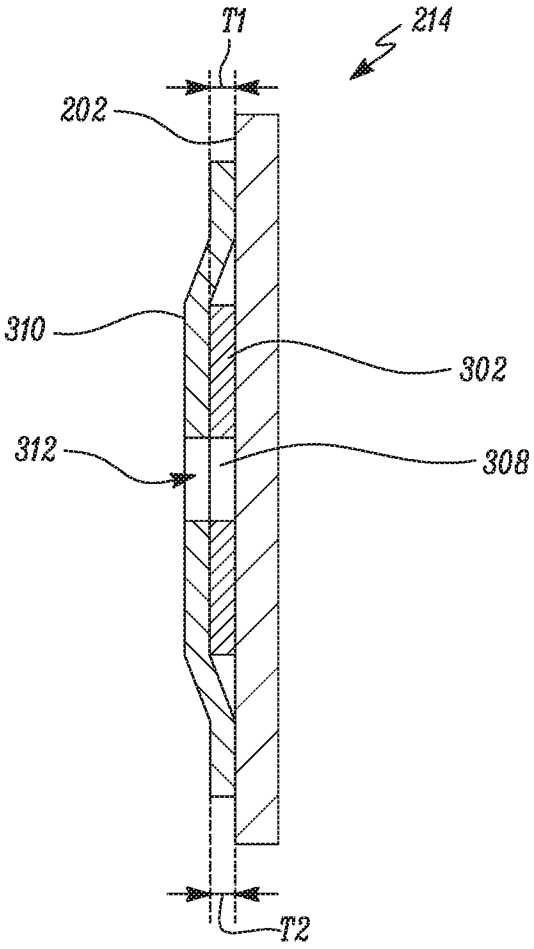
FIG. 4A is a cross sectional view of the patch of FIG. 3 along a section A-A', according to an aspect of the present disclosure.

FIG. 3 further shows a first sectional plane A-A' and a second sectional plane B-B'. Sectional view of the patch 214 through the plane A-A' is shown in FIG. 4A and sectional view of the patch 214 through plane B-B' is shown in FIG.

4B. With combined reference to FIGS. 3, 4A and 4B, the patch 214 includes a first plate 302. The first plate 302 is disposed on the tubular component 202. The first plate 302 defines at least one slot 308. In the illustrated embodiment, the at least one slot 308 includes a single slot 308. However, the first plate 302 may include any appropriate number of slots 308 as per application requirements. In an embodiment, a number of openings 212 is equal to a number of slots 308. The slot 308 has a first end 304 and a second end 306. The first end 304 is disposed towards the opening 212. The second end 306 is disposed opposite to the first end 304. The slot 308 extends between the first end 304 and the second end 306. The slot 308 is in fluid communication with the opening 212 towards the first end 304.

The patch 214 further includes a second plate 310. The second plate 310 is disposed on the first plate 302. The second plate 310 at least partially encloses the first plate 302. The second plate 310 at least partially defines at least one outlet opening 312. In the illustrated embodiment, the second plate 310 defines a single outlet opening 312. However, the second plate 310 may include any appropriate number of outlet openings 312 as per application requirements. In an embodiment, a number of slots 308 is equal to a number of outlet openings 312. The outlet opening 312 is in fluid communication with the slot 308 towards the second end 306.

A secondary exhaust flow path is defined for the exhaust gases flowing through the tubular component 202. The secondary exhaust flow path is defined through the opening 212, the slot 308, and the outlet opening 312. The exhaust gases exit the tubular component 202 through the opening 212, then flow through the slot 308 from the first end 304 towards the second end 306, and then flow out through the outlet opening 312. The secondary exhaust gas flow path resembles a serpentine shape and may be referred to as a serpentine shaped flow path.

The first plate 302 has a first thickness $T_1$ and the second plate 310 has a second thickness $T_2$. In an embodiment, the second thickness $T_2$ is greater than the first thickness $T_1$. However, the present disclosure is not limited by the relative thicknesses of the first plate 302 and the second plate 310 in any manner. Other combinations of relative thicknesses of the first plate 302 and the second plate 310 may be envisioned and are well within the scope of the present disclosure. The first plate 302 and the second plate 310 may have similar or different thickness as per application requirements.

Figure 5:
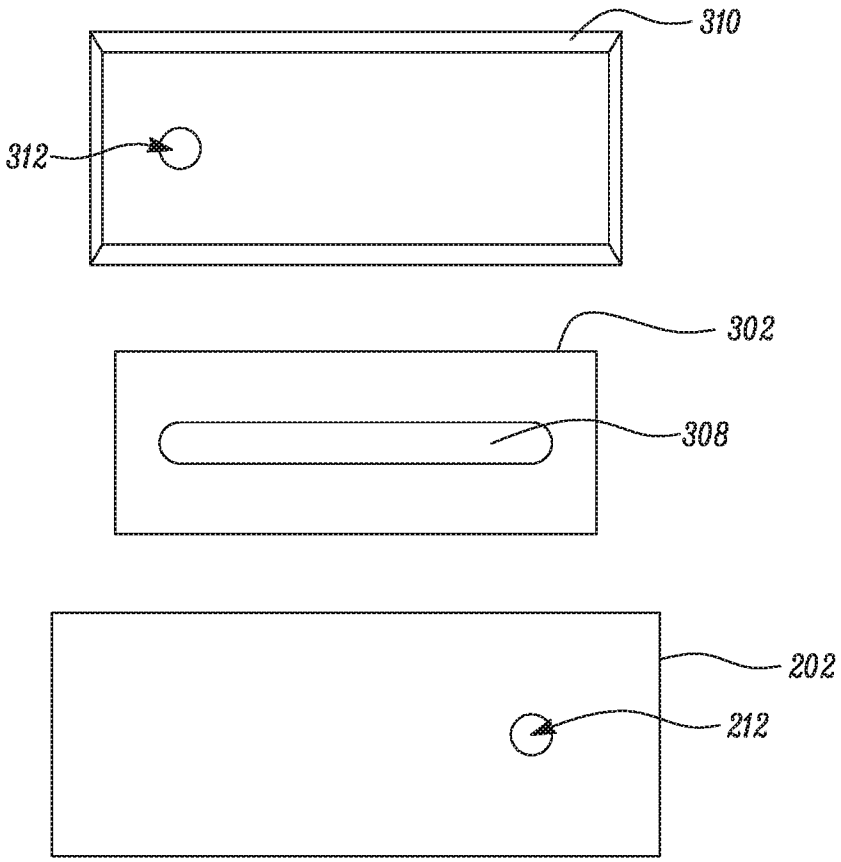
FIG. 5 is an exploded view of the patch of FIG. 3, according to an aspect of the present disclosure.

FIG. 5 shows an exploded view of the patch 214 showing the first plate 302, the second plate 310 and the tubular component 202. The tubular component 202 defines the opening 212. The first plate 302 defines the slot 308, and the second plate 310 defines the outlet opening 312.

Figure 6B:
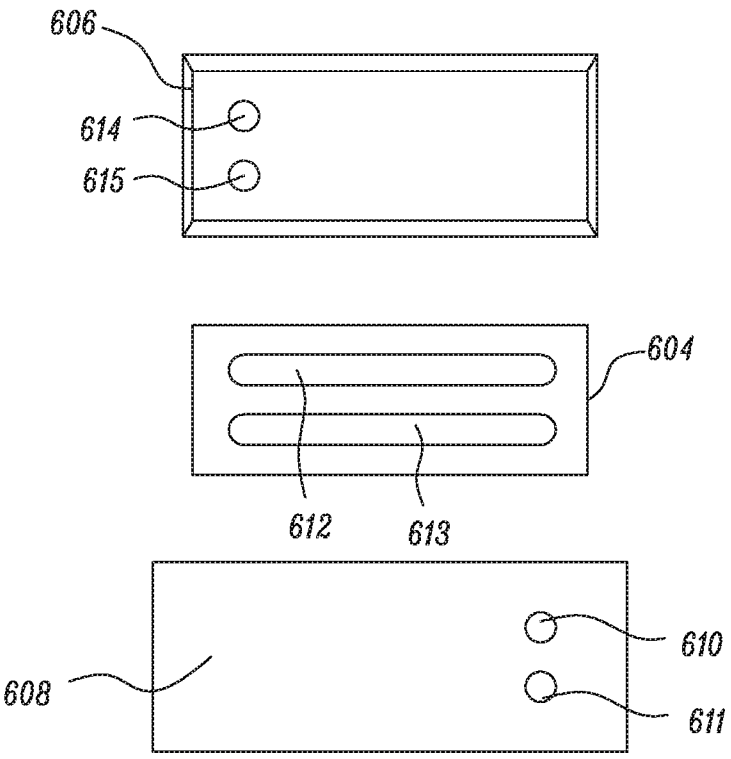
FIG. 6B is an exploded view of the patch of FIG. 6A, according to another aspect of the present disclosure.
Figure 6A:
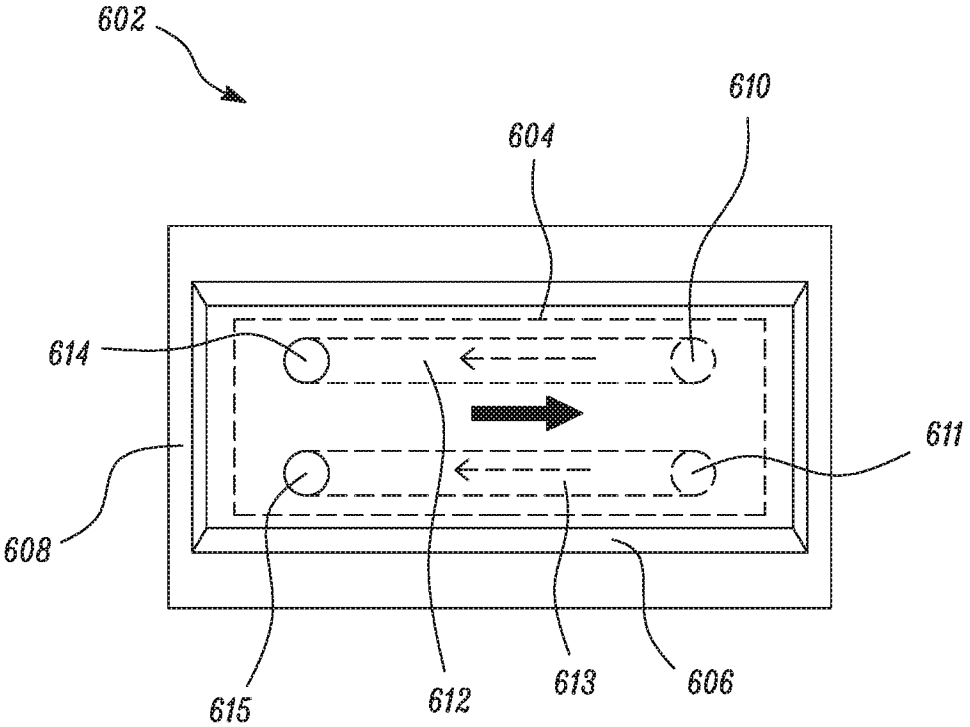
FIG. 6A is a front view of another patch for the tubular component of FIG. 2, according to another aspect of the present disclosure.

FIG. 6A shows a front view of a patch 602 according to another embodiment of the present disclosure. The patch 602 includes a first plate 604 and a second plate 606. FIG. 6B shows an exploded view of the patch 602 disposed over a tubular component 608. With combined reference to FIGS. 6A and 6B, the tubular component 608 includes at least one opening. In the illustrated embodiment, the at least one opening includes a first opening 610 and a second opening 611. Further, the first plate 604 includes at least one slot. In the illustrated embodiment, the at least one slot includes a first slot 612 and a second slot 613. The first slot 612 is fluidly coupled with the first opening 610, and the second slot 613 is fluidly coupled with the second opening 611.

The second plate 606 includes at least one outlet opening. In the illustrated embodiment, the at least one outlet opening includes a first outlet opening 614 and a second outlet opening 615. The first outlet opening 614 is fluidly coupled with the first slot 612 and the second outlet opening 615 is coupled with the second slot 613. The first and second openings 610, 611, the first and second slots 612, 613 and the first and second outlet openings 614, 615 together define a secondary exhaust gas flow path. The exhaust gases flow through the first and second openings 610, 611 in the tubular component 608, the first and second slots 612, 613 and the first and second outlet openings 614, 615.

Figure 7:
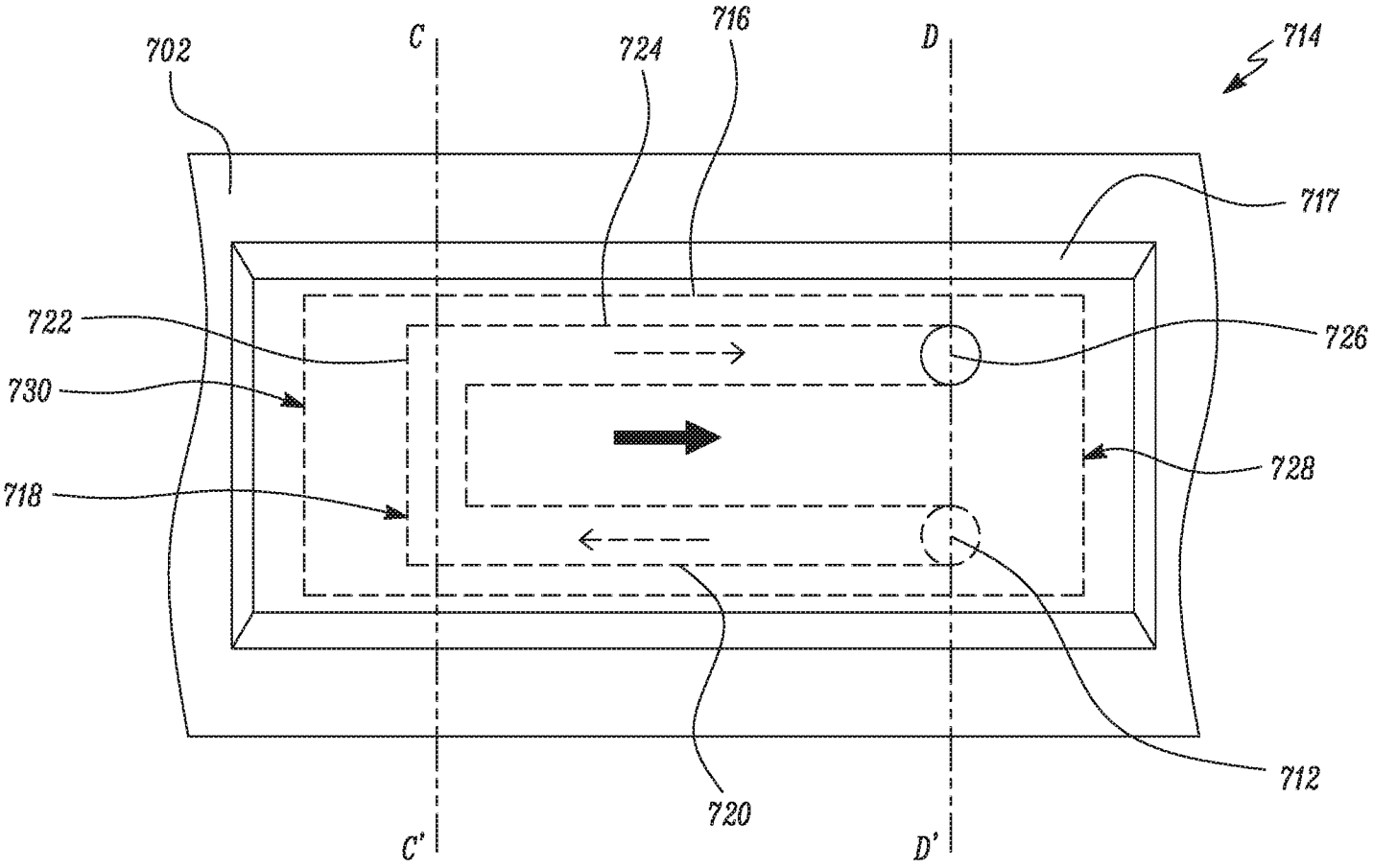
FIG. 7 is a front view of another patch for the tubular component of FIG. 2, according to another aspect of the present disclosure.
Figure 8B:
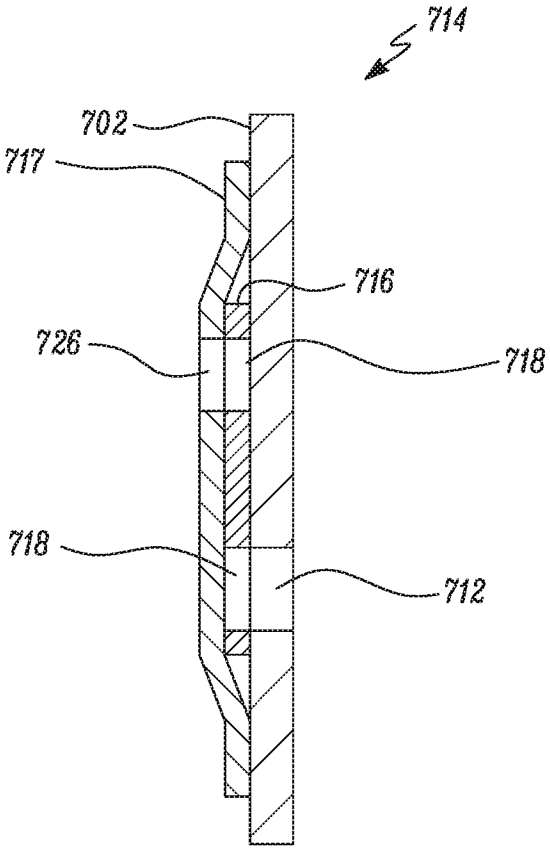
FIG. 8B is a cross sectional view of the patch of FIG. 7 along a section D-D', according to an aspect of the present disclosure.
Figure 8A:
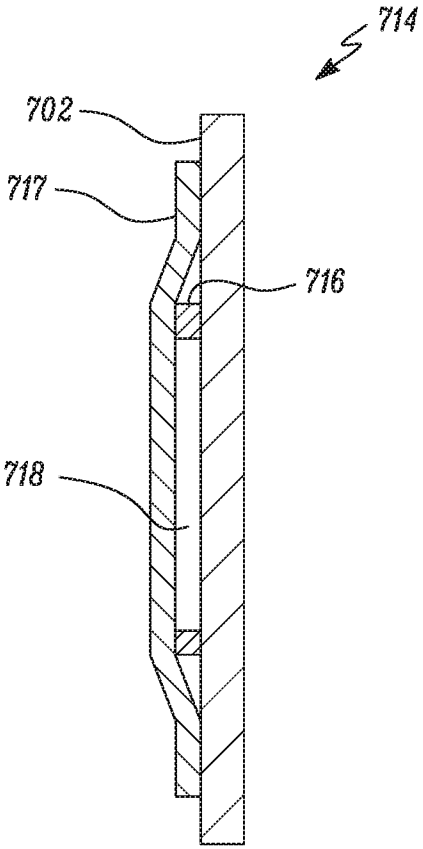
FIG. 8A is a cross sectional view of the patch of FIG. 7 along a section C-C', according to an aspect of the present disclosure.

FIG. 7 shows a third sectional plane C-C' and a fourth sectional plane D-D'. Sectional view of a patch 714 through the plane C-C' is shown in FIG. 8A and sectional view of the patch 714 through plane D-D' is shown in FIG. 8B. With combined reference to FIGS. 7, 8A and 8B, the patch 714 includes a first plate 716 disposed on a tubular component 702. The patch 714 further includes a second plate 717. The second plate 717 at least partially encloses the first plate 716. The first plate 716 at least partially defines at least one flow channel 718 which receives exhaust gases from the at least one opening 712. The flow channel 718 imparts at least one directional change to the received exhaust gases. In the illustrated embodiment, the flow channel 718 is depicted as having a U-shape. The first plate 716 may further include an insert (not shown) disposed on the first plate 716 to define the flow channel 718. The flow channel 718 imparts two directional changes to the received exhaust gases. The flow channel 718 extends generally between a first end 728 of the first plate 716 and a second end 730 of the first plate 716.

The exhaust gases flow along a first arm 720 of the flow channel 718 in a first direction, then change flow direction to flow along a second arm 722. As the flow channel 718 is U-shaped, the first arm 720 is substantially orthogonal to the second arm 722. Further, the exhaust gases change flow direction once again to flow along a third arm 724. The third arm 724 is parallel to the first arm 720, and orthogonal to the second arm 722. The exhaust gases flow along the third arm 724, and then flow out of the tubular component 702 through an outlet opening 726. The outlet opening 726 is defined by the second plate 717 such that the outlet opening 726 receives exhaust gases from the flow channel 718.

Figure 9:
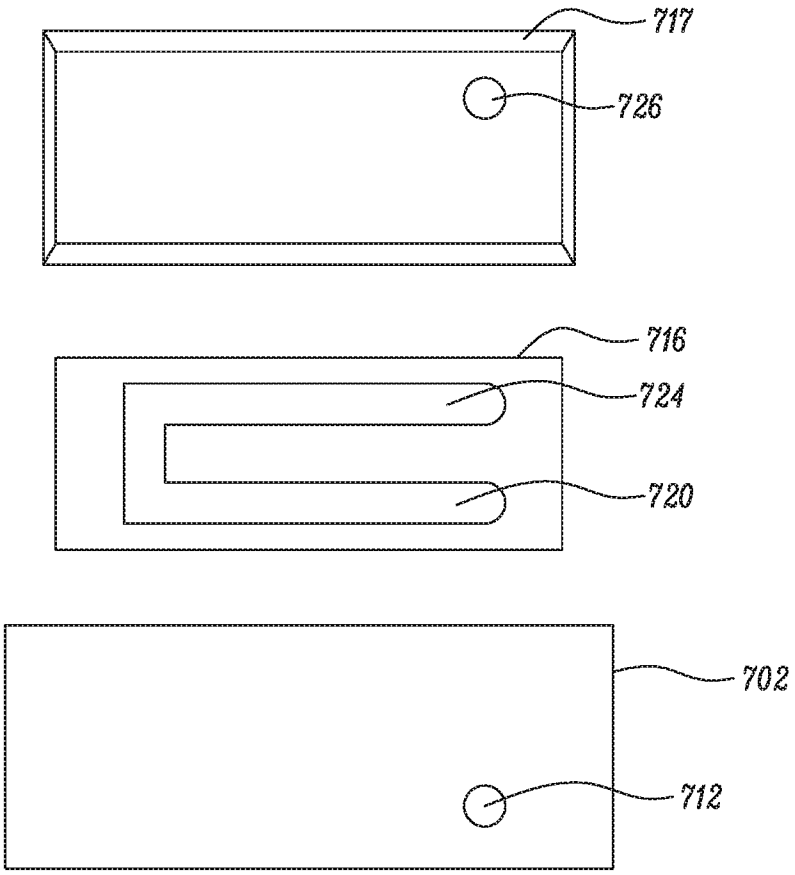
FIG. 9 is an exploded view of the patch of FIG. 7, according to another aspect of the present disclosure.

It should be contemplated that although the flow channel 718 is depicted as U-shaped, various other such shapes may also be envisioned. For example, the shape of the flow channel 718 may be selected from one or more of a U-shape, an L-shape, a Z-shape, or a V-shape. In an embodiment, the flow channel 718 may be helical in shape. All these shapes may impart one or more directional changes to the exhaust gases. Changes in flow direction allows release of sound energy, but further minimizes leakage of exhaust gases. Thus, a secondary exhaust gas flow path is defined through the at least one opening 712 in the tubular component 702, the flow channel 718 defined by the first plate 716, and the outlet opening 726 defined by the second plate 717. In an embodiment, the exhaust gases flow in an upstream direction due to the at least one directional change FIG. 9 shows the patch 714 in an exploded front view. The tubular component 702 includes the at least one opening 712 through which the exhaust gases enter the flow channel 718. The first plate 716 includes the flow channel 718 having the first arm 720 and the third arm 724. The second plate 717 includes the outlet opening 726. As the flow channel 718 is U-shaped, the at least one opening 712, and the outlet opening 726 are both disposed towards the first end 728 of the first plate 716. With change is shapes, there may be changes in relative position of the at least one opening 712, and the outlet opening 726.

Figure 10:
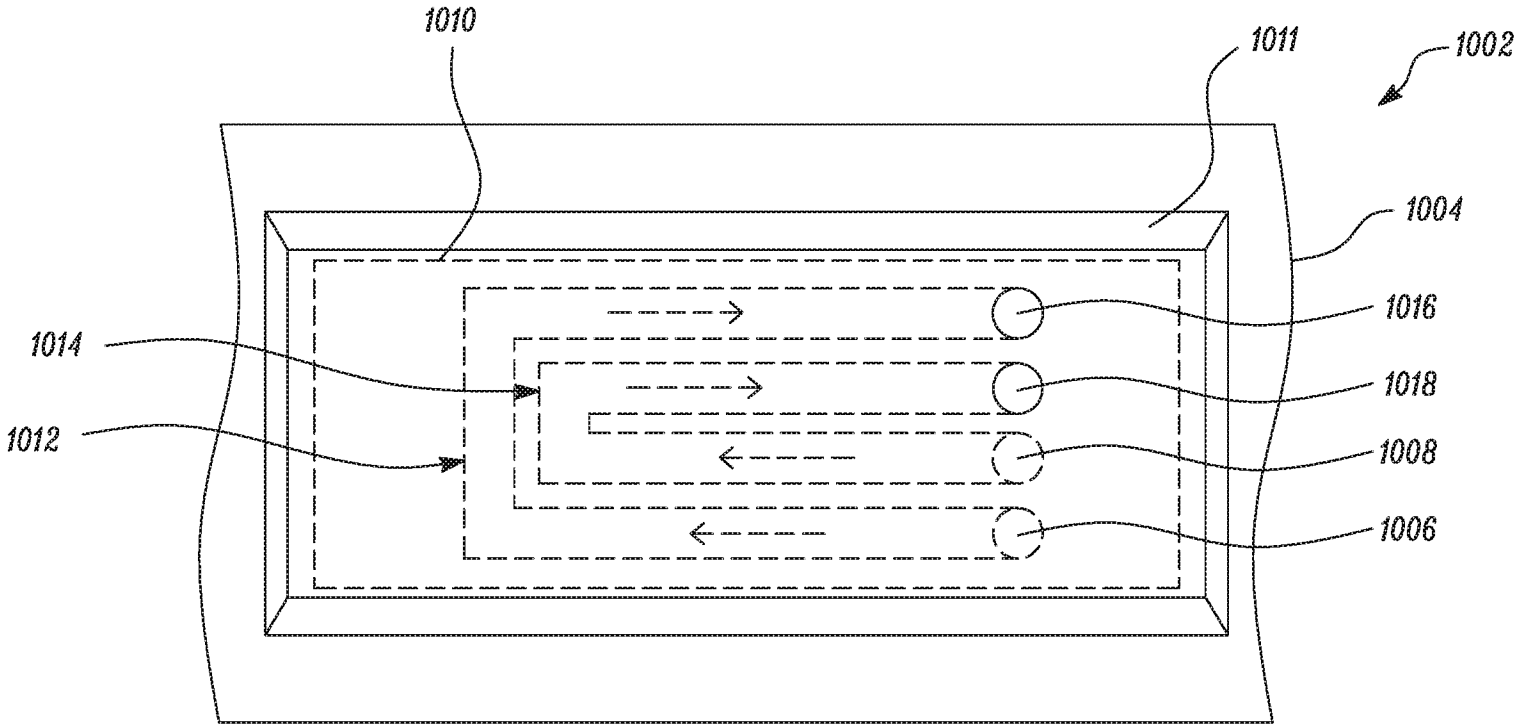
FIG. 10 is a front view of another patch for the tubular component of FIG. 2, according to another aspect of the present disclosure.

FIG. 10 shows another embodiment of the present disclosure. A front view of a patch 1002 is illustrated. In the illustrated embodiment, the patch 1002 has a substantially rectangular configuration. In other embodiments, the patch 1002 may have any other configuration. A tubular component 1004 defines at least one opening. The at least one opening includes a first opening 1006 and a second opening 1008.

The patch 1002 includes a first plate 1010 disposed on the tubular component 1004. The first plate 1010 defines at least one flow channel which receives exhaust gases from the at least one opening. In the illustrated embodiment, the at least one flow channel includes a first flow channel 1012 and a second flow channel 1014. The first flow channel 1012 is fluidly coupled with the first opening 1006 and the second flow channel 1014 is fluidly coupled with the second opening 1008. In the illustrated embodiment, the first and second flow channels 1012, 1014 are depicted as having a U-shape. The first plate 1010 may further include corresponding inserts (not shown) disposed on the first plate 1010 to define the first and second flow channels 1012, 1014. The first and second flow channels 1012, 1014 impart two directional changes to the received exhaust gases. The patch 1002 further includes a second plate 1011.

Figure 11:
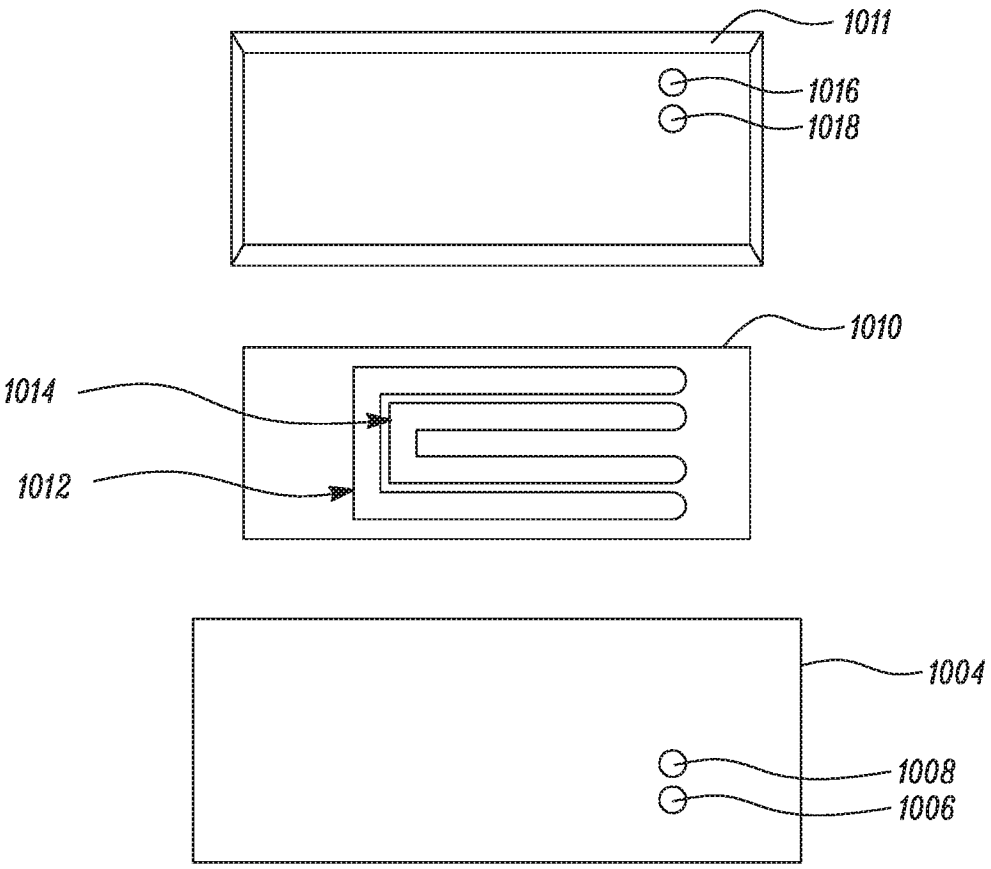
FIG. 11 is an exploded view of the patch of FIG. 10, according to another aspect of the present disclosure.

FIG. 11 depicts exploded front view of the patch 1002 of FIG. 10. With combined reference to FIGS. 10 and 11, the tubular component 1004 defines the first opening 1006 and the second opening 1008 which supply exhaust gases to the first flow channel 1012 and the second flow channel 1014 respectively. The second plate 1011 defines a first outlet opening 1016 and a second outlet opening 1018 such that the first outlet opening 1016 receives exhaust gases from the first flow channel 1012 and the second outlet opening 1018 receives exhaust gases from the second flow channel 1014. The exhaust gases flow from the first opening 1006, then flow through the first flow channel 1012 and exit through the first outlet opening 1016. Similarly, the exhaust gases flow from the second opening 1008, then flow through the second flow channel 1014 and exit through the second outlet opening 1018.

Figure 12A:
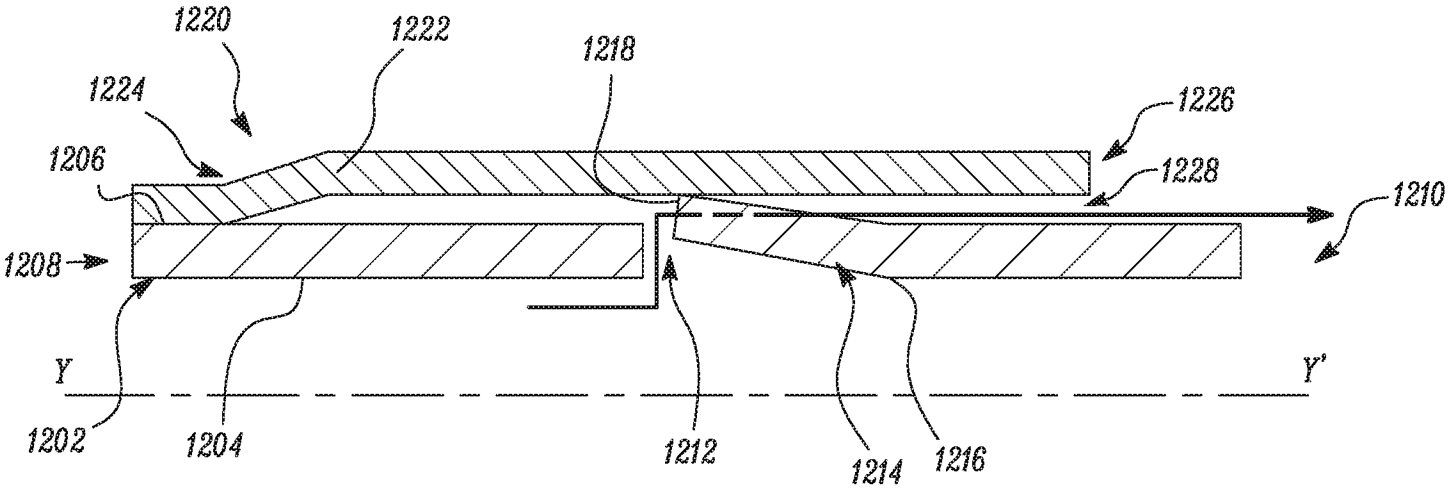
FIG. 12A is a schematic sectional side view of a vehicle exhaust system, in accordance with the present invention.

FIG. 12A shows another embodiment of the present disclosure. A tubular component 1202 for the system 100 is illustrated. In the illustrated embodiment, the tubular component 1202 is the exhaust member 108. In other embodiments, the tubular component 1202 may be any one or more of the exhaust components 104 and/or any portion of the system 100, such as the exhaust pipe, the tailpipe 106, and the like. The tubular component 1202 has a substantially hollow and cylindrical configuration defining a central axis Y-Y'. Accordingly, the tubular component 1202 includes an inner surface 1204 and an outer surface 1206. The tubular component 1202 also includes an inlet end 1208 and an outlet end 1210. The outlet end 1210 is disposed opposite and spaced apart with respect to the inlet end 1208 along the central axis Y-Y'. The tubular component 1202 defines a primary exhaust gas flow path along the inner surface 1204 between the inlet end 1208 and the outlet end 1210 along the central axis Y-Y'.

The tubular component 1202 defines at least one opening 1212. In the illustrated embodiment, the tubular component 1202 defines a single opening 1212. However, the at least one opening 1212 may include any number of openings 1212 as per application requirements, and the present disclosure is not limited by the number of openings 1212 in any manner.

At least one tab portion 1214 is coupled to the opening 1212. In an embodiment, the at least one tab portion 1214 is an integral part of the tubular component 1202. In the illustrated embodiment, the at least one tab portion 1214 includes a single tab portion 1214. However, the at least one tab portion 1214 may include multiple tab portions 1214 as per application requirements. The tab portion 1214 is coupled to the tubular component 1202 at an angular orientation with the central axis Y-Y'. The tab portion 1214 has a first end 1216 and a second end 1218. The tab portion 1214 is coupled to the tubular component 1202 at the first end 1216. The second end 1218 of the tab portion 1214 angularly extends outwards from the tubular component 1202. In an embodiment, the tab portion 1214 extends in an upstream direction. In an embodiment, the at least one tab portion 1214 imparts a directional change to the exhaust gases such that the exhaust gases flow in an upstream direction due to the at least one directional change. The system further includes a patch 1220 which covers the opening 1212. The patch 1220 includes a plate 1222 disposed on the tubular component 1202. The plate 1222 has a first end 1224 and a second end 1226. The first end 1224 of the plate 1222 is disposed towards the opening 1212. The plate 1222 defines at least one outlet opening 1228 towards the second end 1226. In the illustrated embodiment, the plate 1222 defines a single outlet opening 1228.

Figure 12B:
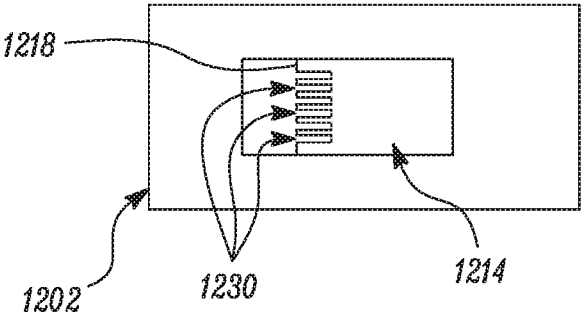
FIG. 12B is a schematic top view of the vehicle exhaust system of FIG. 12A, in accordance with the present invention.

FIG. 12B shows a top view of the tubular component 1202 without the plate 1222. It should be understood that the plate 1222 is not shown for clarity purposes, and the plate 1222 is an integral part of the design of the patch 1220. The tab portion 1214 defines at least one cut-out portion 1230 at the second end 1218 of the tab portion 1214. In the illustrated embodiment, the tab portion 1214 includes multiple cut-out portions 1230 such that the cut-out portions 1230 provide a restriction to flow of exhaust gases. A secondary exhaust gas flow path is defined through the opening 1212 in the tubular component 1202, the cut-out portions 1230 in the tab portion 1214, and the outlet opening 1228 in the plate 1222. The exhaust gases flow from the tubular component 1202 through opening 1212 along the tab portion 1214. The exhaust gases then flow across the multiple cut-out portions 1230 and flow through the outlet opening 1228.

Figure 13:
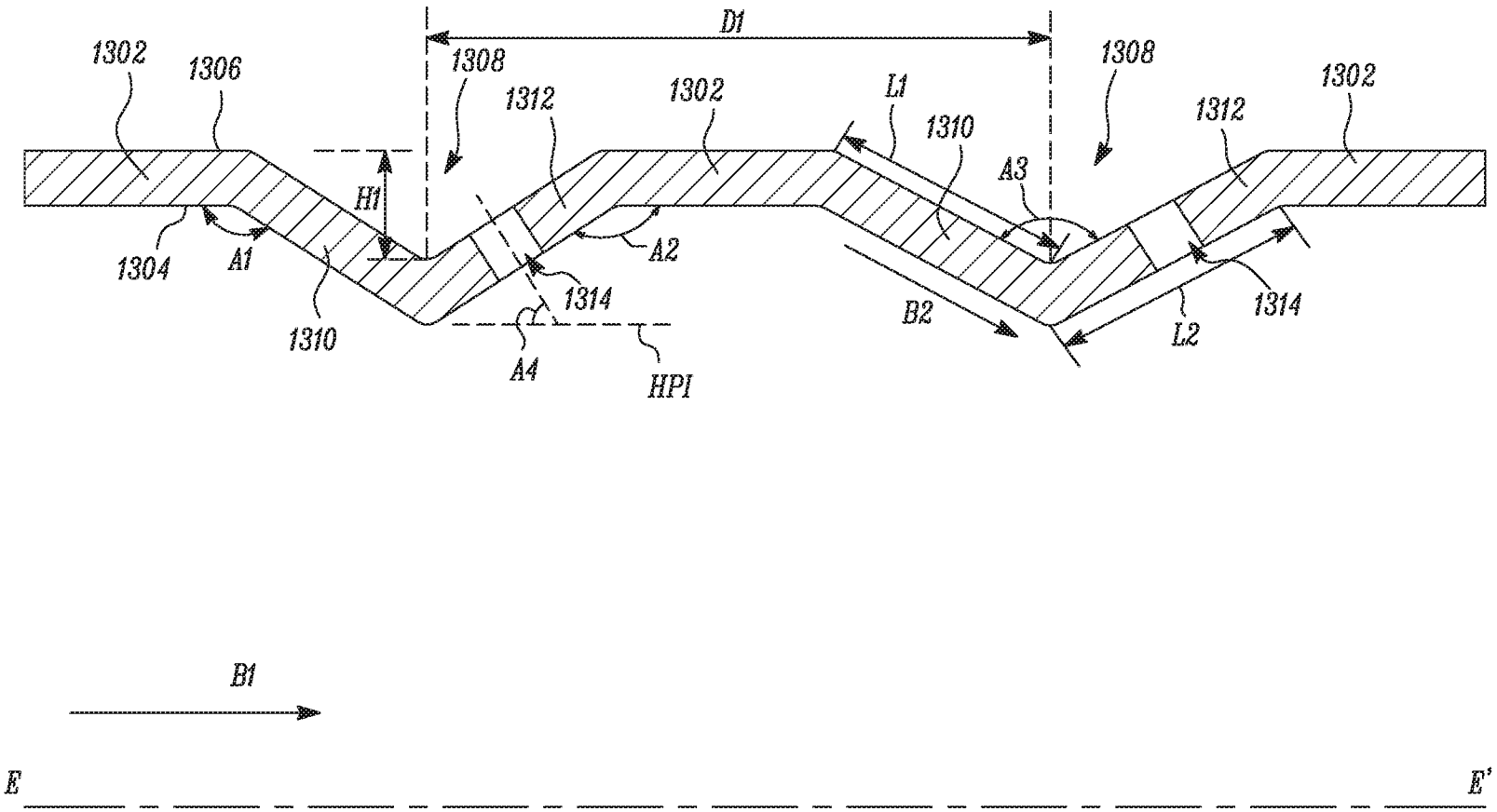
FIG. 13 is a schematic sectional side view of a portion of a tubular component of the vehicle exhaust system of FIG. 1, according to another aspect of the present disclosure.

FIG. 13 illustrates a sectional view of a portion of a tubular component 1302 in accordance with another embodiment of the present disclosure. The tubular component 1302 includes an inner surface 1304 and an outer surface 1306 such that the inner surface 1304 defines a primary exhaust gas flow path, indicated by an arrow B1. The tubular component 1302 is provided in fluid communication with the one or more exhaust components 104 of the vehicle exhaust system 100 (shown in FIG. 1). The one or more exhaust components 104 are fluidly coupled to the engine 102. In some embodiments, the tubular component 1302 is the exhaust member 108 of the vehicle exhaust system 100.

The tubular component 1302 extends along a central axis E-E' from an inlet end to an outlet end. The inlet and outlet ends are not shown in FIG. 13 for the purpose of clarity. The tubular component 1302 includes a plurality of ridges 1308 spaced apart from each other relative to the central axis E-E' of the tubular component 1302. In the illustrated embodiment, the tubular component 1302 includes two ridges 1308. However, the tubular component 1302 may include more than two ridges 1308 as per application requirements. The two ridges 1308 are separated by a distance D1. The distance D1 may vary as per application requirements. In an example, the distance D1 may be in a range, but not limited to, from 25 millimeters (mm) to 50 mm.

Each ridge 1308 extends at least partly along a circumference of the tubular component 1302. For example, an angular extent of each ridge 1308 may be in a range from 120 degrees to 360 degrees. Each ridge 1308 includes a first portion 1310 angularly extending inwardly from the tubular component 1302. Specifically, the first portion 1310 extends inwardly at an angle A1 from a straight cylindrical portion of the tubular component 1302. Each ridge 1308 further includes a second portion 1312 disposed downstream of the first portion 1310. The second portion 1312 angularly extends inwardly from the tubular component 1302. Specifically, the second portion 1312 extends inwardly at an angle A2 from the straight cylindrical portion of the tubular component 1302. In some embodiment, the angle A1 is substantially equal to the angle A2. In other embodiments, the angle A1 is different from the angle A2. Each of the angles A1, A2 may be in a range, but not limited to, from 100 degrees to 170 degrees.

In the illustrated embodiment, each of the first portion 1310 and the second portion 1312 is straight along the central axis E-E'. Further, the second portion 1312 is adjacent to the first portion 1310. In other words, the second portion 1312 is directly connected to the first portion 1310. In other embodiments, an intermediate portion (not shown) may be provided between the first and second portions 1310, 1312. Further, an interface between the first and second portions 1310, 1312 may be rounded. An angle A3 between the first and second portions 1310, 1312 may be in a range, but not limited to, from 20 degrees to 160 degrees. A height H1 of the ridge 1308 may be in a range, but not limited to, from 2 mm to 5 mm. In an example, the height H1 may be about 2.5 mm. In an embodiment, a length L1 of the first portion 1310 may be substantially equal to a length L2 of the second portion 1312. In another embodiments, the lengths L1, L2 of the first and second portions 1310, 1312 may be different from each other.

The second portion 1312 defines a plurality of openings 1314 (only one shown in FIG. 13) extending therethrough and spaced apart from each other. A number of the openings 1314 may vary as per application requirements. In an example, each ridge 1308 may include seven openings 1314 uniformed spaced along the circumference of the tubular component 1302. However, an angular spacing between the openings 1314 may be non-uniform and vary as per application requirements. Each opening 1314 is inclined at an angle A4 relative to the central axis E-E'. Specifically, the angle A4 is defined between a normal to the opening 1314 and a horizontal plane HP1. The angle A4 may be in a range, but not limited to, from 38 degrees to 40 degrees. In an embodiment, each opening 1314 has a suitable shape. In an example, each opening 1314 has an area of at least 3.14 square millimeters ($mm^2$). The shape and dimensions of each opening 1314 may vary as per application requirements. In various embodiments, the shape of each opening 1314 may be, but not limited to, circular, oval, polygonal, or elliptical.

The ridges 1308 may allow control of one or more acoustic modes (e.g., standing wave) within the tubular component 1302. The openings 1314 may expose an interior of the tubular component 1302 to atmosphere at multiple locations to break up one or more acoustic modes. The geometry of the first and second portions 1310, 1312 may reduce or eliminate the escape of exhaust gases through the openings 1314. Specifically, the first portion 1310 may guide exhaust gases away from the openings 1314, as indicated by an arrow B2. The geometry of the first and second portions 1310, 1312 may also create a low pressure zone adjacent to the second portion 1312 that reduces or eliminates escape of exhaust gases through the openings 1314. An inclination of each opening 1314 relative to the horizontal plane HP1, as indicated by the angle A4, may also reduce or eliminate escape of exhaust gases through the openings 1314. The ridges 1308 may therefore allow control of one or more acoustic modes within the tubular component 1302 without any additional tuning elements, while reducing or eliminating escape of exhaust gases.

Figure 14:
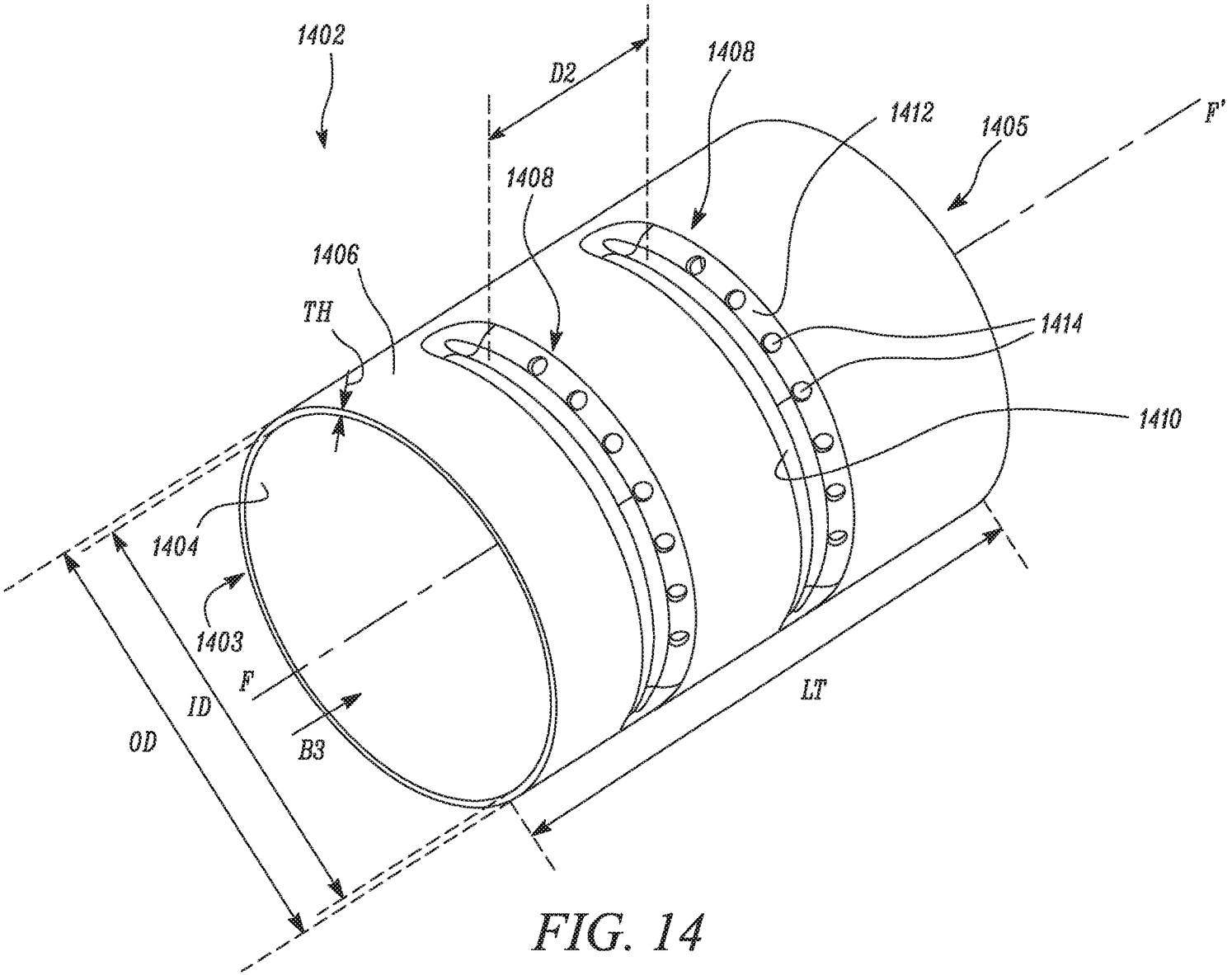
FIG. 14 is a perspective view of a tubular component of the vehicle exhaust system of FIG. 1, according to another aspect of the present disclosure.

FIG. 14 illustrates a perspective view of a tubular component 1402 in accordance with another embodiment of the present disclosure. The tubular component 1402 includes an inner surface 1404 and an outer surface 1406 such that the inner surface 1404 defines a primary exhaust gas flow path, indicated by an arrow B3. The tubular component 1402 is provided in fluid communication with the one or more exhaust components 104 of the vehicle exhaust system 100 (shown in FIG. 1). The one or more exhaust components 104 are fluidly coupled to the engine 102. In some embodiments, the tubular component 1402 is the exhaust member 108 of the vehicle exhaust system 100. An outer diameter OD, an inner diameter ID, a thickness TH, and a length LT of the tubular component 1402 may be varied as per application requirements.

The tubular component 1402 extends along a central axis F-F' from an inlet end 1403 to an outlet end 1405. The tubular component 1402 includes a plurality of ridges 1408 spaced apart from each other relative to the central axis F-F' of the tubular component 1402. In the illustrated embodiment, the tubular component 1402 includes two ridges 1408. However, the tubular component 1402 may include more than two ridges 1408 as per application requirements. The two ridges 1408 are separated by a distance D2. The distance D2 may vary as per application requirements.

Figure 15:
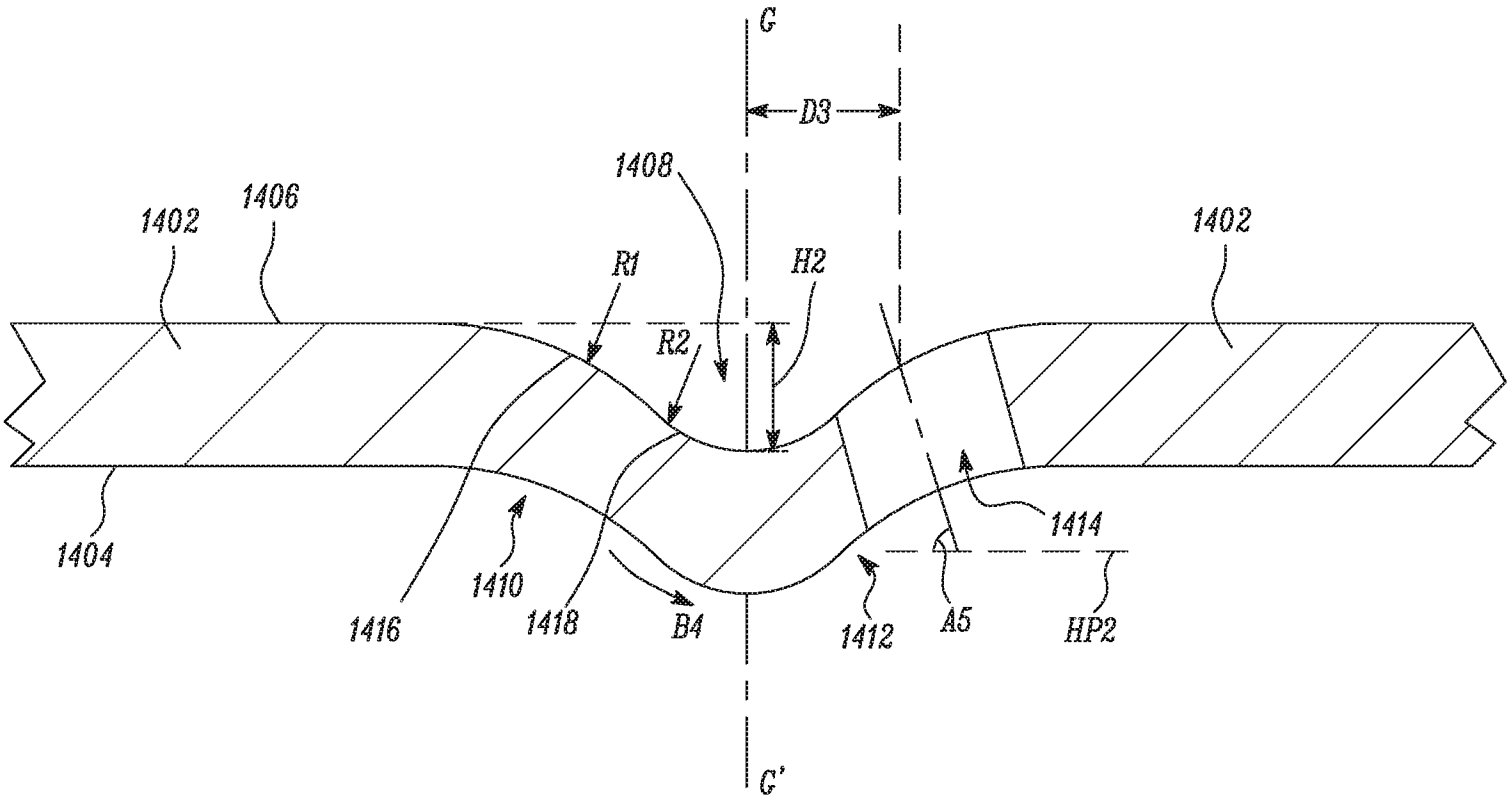
FIG. 15 is a schematic sectional side view of a portion of the tubular component of FIG. 14, according to an aspect of the present disclosure.

FIG. 15 is a sectional side view of one of the ridges 1408 of the tubular component 1402. Referring to FIGS. 14 and 15, each ridge 1408 extends at least partly along a circumference of the tubular component 1402. Each ridge 1408 includes a first portion 1410 angularly extending inwardly from the tubular component 1402. Each ridge 1408 further includes a second portion 1412 disposed downstream of the first portion 1410. The second portion 1412 angularly extends inwardly from the tubular component 1402. The second portion 1412 is adjacent to the first portion 1410. In other words, the second portion 1412 is directly connected to the first portion 1410. The second portion 1412 further defines a plurality of openings 1414 extending therethrough and spaced apart from each other.

Each of the first portion 1410 and the second portion 1412 is curved along the central axis F-F'. Further, the first and second portions 1410, 1412 have a substantially similar shape. The ridge 1408 may be substantially symmetric about a ridge axis G-G' except for the openings 1414. In alternative embodiments, the first and second portions 1410, 1412 may have different shapes. Each of the first and second portions 1410, 1412 includes a first section 1416 extending from the tubular component 1402 and a second section 1418 extending from the first section 1416. The first section 1416 curves outwards relative to the central axis F-F'. The second section 1418 curves inwards relative to the central axis F-F'. In an embodiment, a radius of curvature R1 of the first section 1416 may be different from a radius of curvature R2 of the second section 1418. For example, the radius of curvature R1 may be greater than the radius of curvature R2. The second sections 1418 meet to form a rounded end of the ridge 1408. The ridge 1408 further has a height H2 measured along the ridge axis G-G'.

A number of the openings 1414 may vary as per application requirements. In the illustrated embodiment, each ridge 1408 includes a number of openings 1414 uniformed spaced along the circumference of the tubular component 1402. However, an angular spacing between the openings 1414 may be non-uniform and vary as per application requirements. Each opening 1414 is inclined at an angle A5 relative to the central axis F-F'. Specifically, the angle A5 is defined between a normal to the opening 1414 and a horizontal plane HP2. In an embodiment, each opening 1414 has a suitable shape. In an example, each opening 1414 has an area of at least 3.14 $mm^2$. The shape and dimensions of each opening 1414 may vary as per application requirements. In various embodiments, the shape of each opening 1414 may be, but not limited to, circular, oval, polygonal, or elliptical. A distance D3 between a center of each opening 1414 and the ridge axis G-G' may be varied as per application requirements.

The ridges 1408 may allow control of one or more acoustic modes (e.g., standing wave) within the tubular component 1402. The openings 1414 may expose an interior of the tubular component 1402 to atmosphere at multiple locations to break up one or more acoustic modes. The geometry of the first and second portions 1410, 1412 may reduce or eliminate the escape of exhaust gases through the openings 1414. Specifically, the first portion 1410 may guide exhaust gases away from the openings 1414, as indicated by an arrow B4. The geometry of the first and second portions 1410, 1412 may also create a low pressure zone adjacent to the second portion 1412 that reduces or eliminates escape of exhaust gases through the openings 1414. An inclination of each opening 1414 relative to the horizontal plane HP2, as indicated by the angle A5, may also reduce or eliminate escape of exhaust gases through the openings 1414. The ridges 1408 may therefore allow control of one or more acoustic modes within the tubular component 1402 without any additional tuning elements, while reducing or eliminating escape of exhaust gases.

Figure 16:
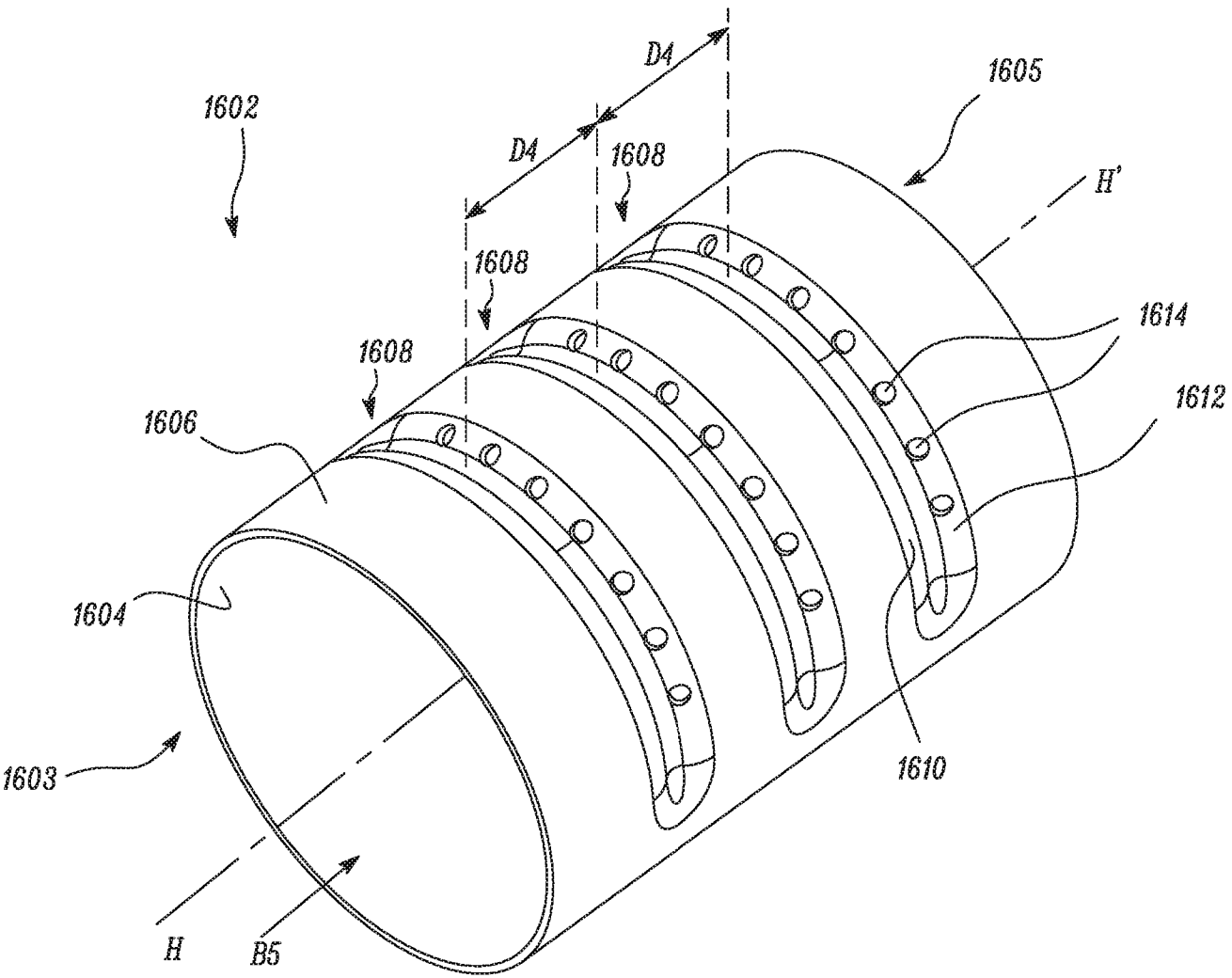
FIG. 16 is a perspective view of a tubular component of the vehicle exhaust system of FIG. 1, according to another aspect of the present disclosure.

FIG. 16 illustrates a perspective view of a tubular component 1602 in accordance with another embodiment of the present disclosure. The tubular component 1602 includes an inner surface 1604 and an outer surface 1606 such that the inner surface 1604 defines a primary exhaust gas flow path, indicated by an arrow B5. The tubular component 1602 is provided in fluid communication with the one or more exhaust components 104 of the vehicle exhaust system 100 (shown in FIG. 1). The one or more exhaust components 104 are fluidly coupled to the engine 102. In some embodiments, the tubular component 1602 is the exhaust member 108 of the vehicle exhaust system 100.

The tubular component 1602 extends along a central axis H-H' from an inlet end 1603 to an outlet end 1605. The tubular component 1602 includes a plurality of ridges 1608 spaced apart from each other relative to the central axis H-H' of the tubular component 1602. The tubular component 1602 is substantially similar in structure to the tubular component 1402 described above with reference to FIGS. 14 and 15. However, the tubular component 1602 includes three ridges 1608 instead of two ridges 1408. Each ridge 1608 is substantially similar to the ridge 1408 of the tubular component 1402. Each ridge 1608 includes a first portion 1610, a second portion 1612 and a plurality of openings 1614 similar to the first portion 1410, the second portion 1412 and the plurality of openings 1414, respectively, of the ridge 1408. The ridges 1608 may allow control of one or more acoustic modes within the tubular component 1602. In the illustrated embodiment, the ridges 1608 are disposed along a length of the tubular component 1602. Alternatively, the ridges 1608 may be non-uniformly disposed along the length of the tubular component 1602. Further, a distance D4 between adjacent ridges 1608 may vary as per application requirements.

It should be noted that the various dimensional details of the tubular components 1302, 1402, 1602 provided above are exemplary in nature, and the dimensions can vary as per application requirements.

Figure 17:
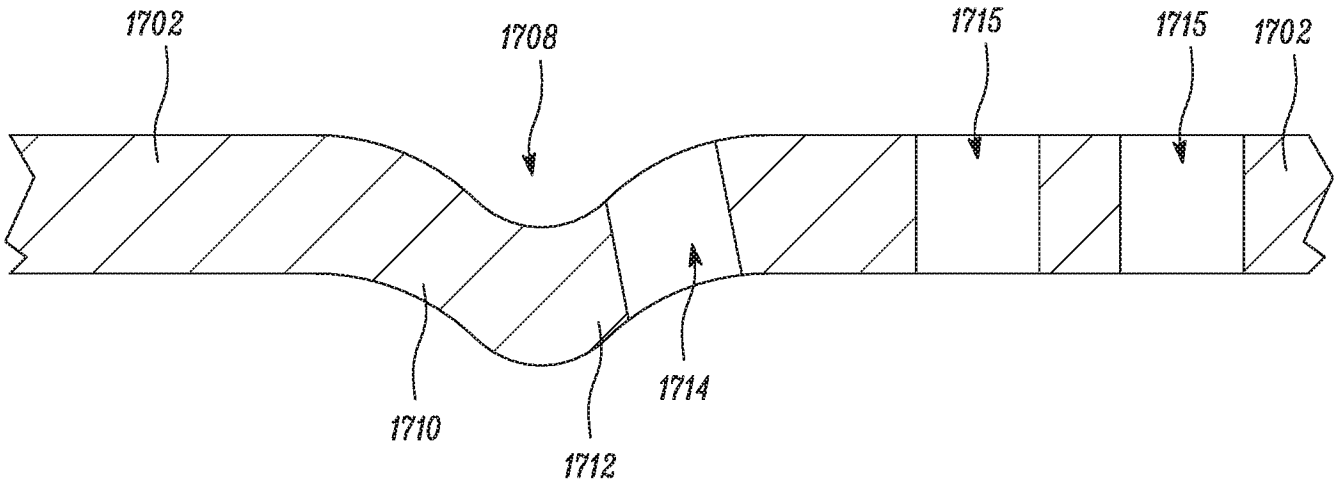
FIG. 17 is a schematic sectional side view of a portion of a tubular component of the vehicle exhaust system of FIG. 1, according to another aspect of the present disclosure.

FIG. 17 is a sectional side view of a tubular component 1702 including at least one ridge 1708. In an embodiment, the tubular component 1702 is the exhaust member 108 of the vehicle exhaust system 100 of FIG. 1. The ridge 1708 may be substantially similar to the ridge 1408 shown in FIGS. 14 and 15. The ridge 1708 includes a first portion 1710 and a second portion 1712 adjacent to the first portion 1710. The first portion 1710 angularly extends inwardly from the tubular component 1702. The second portion 1712 angularly extends inwardly from the tubular component 1702. The ridge 1708 defines a plurality of openings 1714 therethrough. The tubular component 1702 further defines a plurality of tube openings 1715 disposed downstream of the ridge 1708. The tube openings 1715 extend through the tubular component 1702. The tube openings 1715 are axially spaced apart from the ridge 1708 along the length of the tubular component 1702. Some of the tube openings 1715 may be axially spaced apart from each other along the length of the tubular component 1702. Further, some of the tube openings 1715 may be angularly spaced apart from each other. For example, the tube openings 1715 may be arranged in multiple angular rows disposed along the length of the tubular component 1702. The tube openings 1715 may allow control of one or more acoustic modes (e.g., standing wave) within the tubular component 1702.

Figure 18:
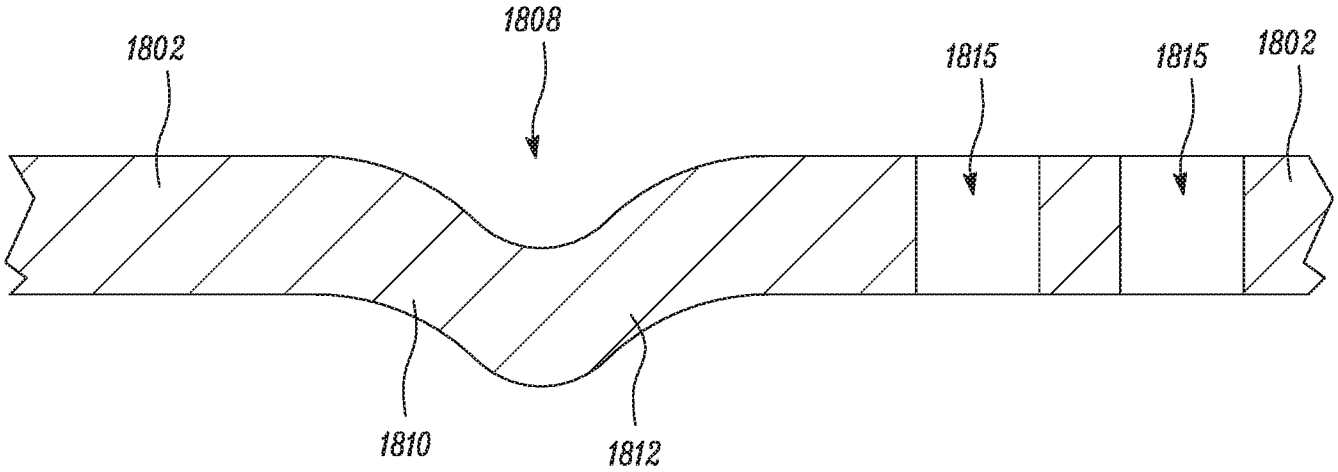
FIG. 18 is a schematic sectional side view of a portion of a tubular component of the vehicle exhaust system of FIG. 1, according to another aspect of the present disclosure.

FIG. 18 is a sectional side view of a tubular component 1802 including at least one ridge 1808. In an embodiment, the tubular component 1802 is the exhaust member 108 of the vehicle exhaust system 100 of FIG. 1. A shape of the ridge 1808 may be substantially similar to the shape of the ridge 1408 shown in FIGS. 14 and 15. The ridge 1808 includes a first portion 1810 and a second portion 1812 adjacent to the first portion 1810. The first portion 1810 angularly extends inwardly from the tubular component 1802. The second portion 1812 angularly extends inwardly from the tubular component 1802. However, the ridge 1808 is devoid of any openings. The tubular component 1802 further defines a plurality of tube openings 1815 disposed downstream of the ridge 1808. The tube openings 1815 extend through the tubular component 1802. The tube openings 1815 are axially spaced apart from the ridge 1808 along the length of the tubular component 1802. Some of the tube openings 1815 may be axially spaced apart from each other along the length of the tubular component 1802. Further, some of the tube openings 1815 may be angularly spaced apart from each other. For example, the tube openings 1815 may be arranged in multiple angular rows disposed along the length of the tubular component 1802. The tube openings 1815 may allow control of one or more acoustic modes (e.g., standing wave) within the tubular component 1802.

Figure 19:
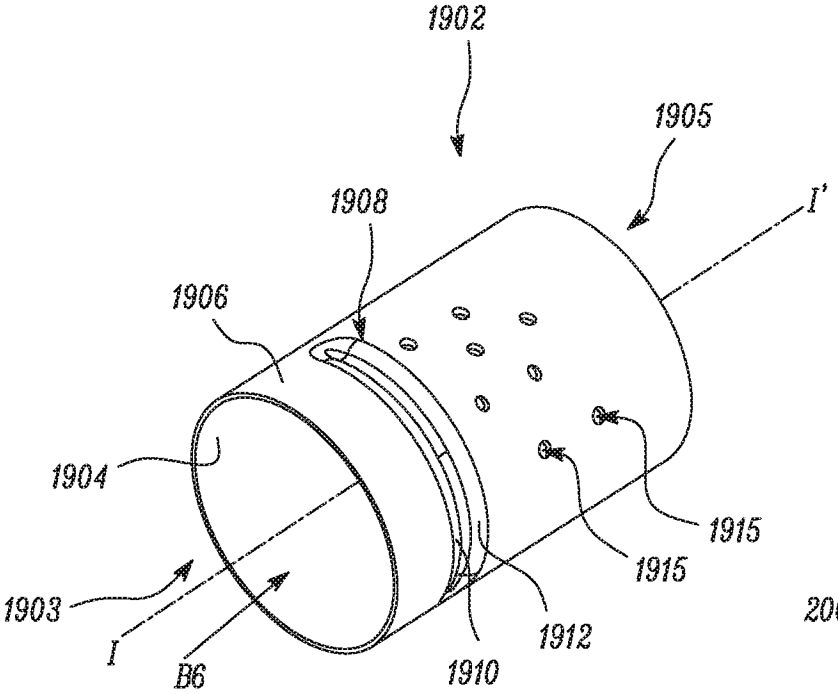
FIG. 19 is a perspective view of a tubular component of the vehicle exhaust system of FIG. 1, according to another aspect of the present disclosure.

FIG. 19 is a perspective view of a tubular component 1902. The tubular component 1902 includes an inner surface 1904 and an outer surface 1906 such that the inner surface 1904 defines a primary exhaust gas flow path, indicated by an arrow B6. The tubular component 1902 is provided in fluid communication with the one or more exhaust components 104 of the vehicle exhaust system 100 (shown in FIG. 1). In an embodiment, the tubular component 1902 is the exhaust member 108 of the vehicle exhaust system 100 of FIG. 1. The tubular component 1902 extends along a central axis I-I' from an inlet end 1903 to an outlet end 1905.

The tubular component 1902 includes a ridge 1908. A shape and dimensions of the ridge 1908 may be substantially similar to the ridge 1408 shown in FIGS. 14 and 15. However, the ridge 1908 is devoid of any openings. The ridge 1908 includes a first portion 1910 and a second portion 1912. The tubular component 1902 further defines a plurality of tube openings 1915 disposed downstream of the ridge 1908. The tube openings 1915 extend through the tubular component 1902. The tube openings 1915 are axially spaced apart from the ridge 1908 along the length of the tubular component 1902. The tube openings 1915 may be arranged in any suitable manner on the tubular component 1902 such that the tube openings 1915 are disposed within an angular extent of the ridge 1908. Each tube opening 1915 has a circular shape. The tube openings 1915 may allow control of one or more acoustic modes (e.g., standing wave) within the tubular component 1902.

Figure 20:
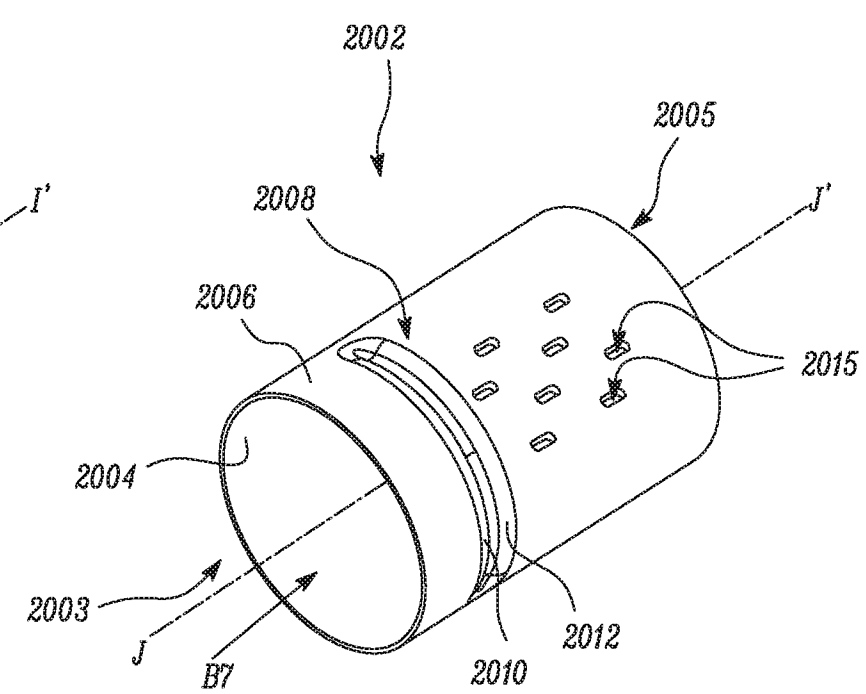
FIG. 20 is a perspective view of a tubular component of the vehicle exhaust system of FIG. 1, according to another aspect of the present disclosure.

FIG. 20 is a perspective view of a tubular component 2002. The tubular component 2002 includes an inner surface 2004 and an outer surface 2006 such that the inner surface 2004 defines a primary exhaust gas flow path, indicated by an arrow B7. The tubular component 2002 is provided in fluid communication with the one or more exhaust components 104 of the vehicle exhaust system 100 (shown in FIG. 1). In an embodiment, the tubular component 2002 is the exhaust member 108 of the vehicle exhaust system 100 of FIG. 1. The tubular component 2002 extends along a central axis J-J' from an inlet end 2003 to an outlet end 2005.

The tubular component 2002 includes a ridge 2008 similar to the ridge 1908 shown in FIG. 19. The ridge 2008 includes a first portion 2010 and a second portion 2012. The ridge 2008 is devoid of any openings. The tubular component 2002 further defines a plurality of tube openings 2015 disposed downstream of the ridge 2008. The tube openings 2015 extend through the tubular component 2002. The tube openings 2015 are axially spaced apart from the ridge 2008 along the length of the tubular component 2002. The tube openings 2015 may be arranged in any suitable manner on the tubular component 2002 such that the tube openings 2015 are disposed within an angular extent of the ridge 2008. Each tube opening 2015 is shaped like a slot. Specifically, each tube opening 2015 has an oval shape. The tube openings 2015 may allow control of one or more acoustic modes (e.g., standing wave) within the tubular component 2002.

Figure 21:
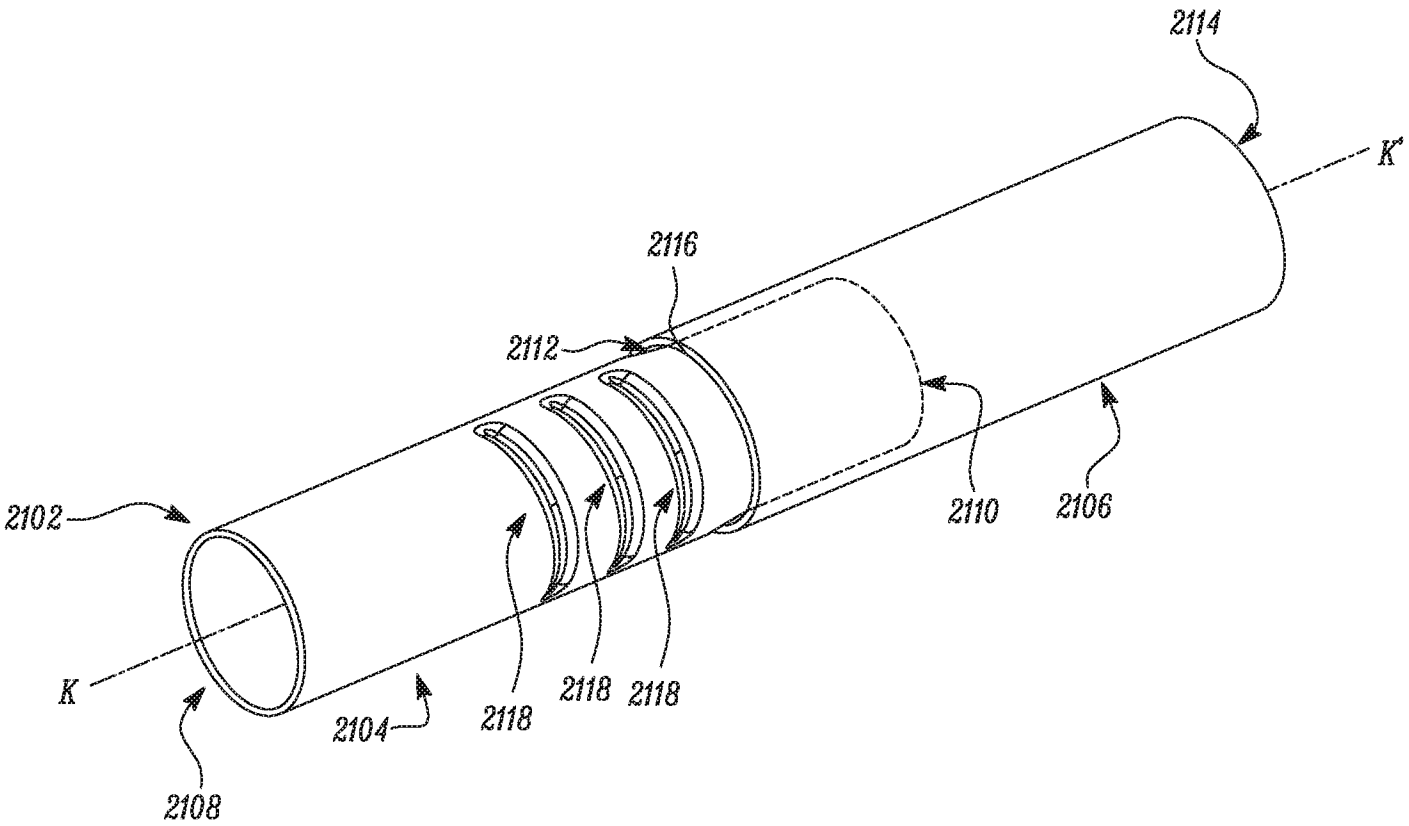
FIG. 21 is a perspective view of a tubular component of the vehicle exhaust system of FIG. 1, according to another aspect of the present disclosure.

FIG. 21 is a perspective view of a tubular component 2102. In an embodiment, the tubular component 2102 is the exhaust member 108 of the vehicle exhaust system 100 of FIG. 1. The tubular component 2102 has a substantially hollow and cylindrical configuration defining a central axis K-K'.

The tubular component 2102 includes an upstream pipe 2104 and a downstream pipe 2106. The upstream pipe 2104 has a first end 2108 and a second end 2110. The first end 2108 may be construed as an inlet end and the second end 2110 may be construed as an outlet end for the upstream pipe 2104. Exhaust gases flow through the upstream pipe 2104 from the first end 2108 to the second end 2110. Similarly, the downstream pipe 2106 has a third end 2112 and a fourth end 2114. The fourth end 2114 may be construed as an outlet end for the downstream pipe 2106.

Exhaust gases enter the tubular component 2102 at the first end 2108 of the upstream pipe 2104 and exit through the fourth end 2114 of the downstream pipe 2106 defining a primary exhaust gas flow path. The fourth end 2114 of the downstream pipe 2106 may be further coupled to any other suitable component of the vehicle exhaust system 100 as per application requirements.

The upstream pipe 2104 and the downstream pipe 2106 are coupled to each other. In an embodiment, the upstream pipe 2104 and the downstream pipe 2106 are coupled to each other through welding. In other embodiments, the upstream pipe 2104 and the downstream pipe 2106 may be coupled to each other through any other suitable mechanical joining techniques and the present disclosure is not limited by means of joining of the upstream pipe 2104 and the downstream pipe 2106 in any manner.

In an embodiment, a pipe joint 2116 is formed between the upstream pipe 2104 and the downstream pipe 2106 at the third end 2112 of the downstream pipe 2106. The pipe joint 2116 may extend through 360 degrees. The upstream pipe 2104 includes a plurality of ridges 2118 disposed adjacent to the pipe joint 2116. In the illustrated embodiment, the upstream pipe 2104 includes three ridges 2118 that are devoid of any openings. A shape of each ridge 2118 is substantially similar to the shape of the ridge 1808 shown in FIG. 18. The ridges 2118 may be locating ridges that enable manufacturing access to backside or inside of the downstream pipe 2106.

The third end 2112 of the downstream pipe 2106 at least partially encloses the second end 2110 of the upstream pipe 2104. The upstream pipe 2104 and the downstream pipe 2106 together define a junction region (not shown). The junction region extends across an overlapping extent of both the upstream pipe 2104 and the downstream pipe 2106. A diameter of the upstream pipe 2104 at the second end 2110 may be smaller than a diameter of the downstream pipe 2106 at the third end 2112 to facilitate at least partial enclosure of the upstream pipe 2104 by the downstream pipe 2106. It may be contemplated that the diameters of the upstream pipe 2104 and the downstream pipe 2106 are substantially equal apart from the junction region.

The downstream pipe 2106 at least partially defines an opening (not shown) within the junction region. The opening provides a secondary exhaust gas flow path for the exhaust gases. A volume of the exhaust gases flowing through the secondary exhaust gas flow path is less than a volume of the exhaust gases flowing through the primary exhaust gas flow path. The upstream pipe 2104 has a round shape and has a straight profile in the junction region. In an embodiment, the junction region may be filled with a wire mesh (not shown).

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof

What is claimed is:

1. A vehicle exhaust system comprising:

a tubular component having an inner surface and an outer surface such that the inner surface defines a primary exhaust gas flow path, wherein the tubular component extends along a central axis from an inlet end to an outlet end, the tubular component including a plurality of ridges spaced apart from each other relative to the central axis of the tubular component, each ridge extending at least partly along a circumference of the tubular component, each ridge including:

a first portion angularly extending inwardly from the tubular component, and a second portion disposed downstream of the first portion, the second portion angularly extending inwardly from the tubular component, wherein the second portion defines a plurality of openings extending therethrough and spaced apart from each other, wherein the plurality of ridges comprises at least two ridges spaced from each other along the outer surface of the tubular component with each of the at least two ridges comprising first portions that direct sound away from the plurality of openings in the corresponding downstream second portions.

2. The vehicle exhaust system of claim 1, wherein each of the first portion and the second portion is curved along the central axis.

3. The vehicle exhaust system of claim 1, wherein each of the first portion and the second position is straight along the central axis.

4. The vehicle exhaust system of claim 1, wherein the second portion is adjacent to the first portion.

5. The vehicle exhaust system of claim 1, wherein each opening has an area of at least 3.14 $mm^2$.

6. The vehicle exhaust system of claim 1 wherein the tubular component is a single tube.

7. The vehicle exhaust system of claim 1 wherein at the first portions of the at least two ridges contain no apertures.

8. The vehicle exhaust system of claim 1 wherein the second portion is directly connected to the first portion forming a V-shape.

9. The vehicle exhaust system of claim 1 wherein each of the plurality of openings is inclined at an angle relative to the central axis.

10. The vehicle exhaust system of claim 9 wherein each of the plurality of openings is perpendicular to the outer surface defining the second portion.

11. The vehicle exhaust system of claim 9 wherein the inclined plurality of openings reduces an escape of exhaust gases through the plurality of openings.

12. The vehicle exhaust system of claim 1 wherein the first and second portions create a low pressure zone adjacent to the second portion that reduces an escape of exhaust gases through the plurality of openings.

13. The vehicle exhaust system of claim 1 wherein the first and second ridges are identical.

14. A vehicle exhaust system comprising:

one or more exhaust components fluidly coupled to an engine; and a tubular component provided in fluid communication with the one or more exhaust components, the tubular component having an inner surface and an outer surface such that the inner surface defines a primary exhaust gas flow path, wherein the tubular component extends along a central axis from an inlet end to an outlet end, the tubular component including a plurality of ridges spaced apart from each other relative to the central axis of the tubular component, each ridge extending at least partly along a circumference of the tubular component, each ridge including:

a first portion angularly extending inwardly from the tubular component; and a second portion disposed adjacent to and downstream of the first portion, the second portion angularly extending inwardly from the tubular component, wherein the second portion defines a plurality of openings extending therethrough and spaced apart from each other; and wherein the plurality of ridges comprises at least two ridges spaced from each other along the outer surface of the tubular component with each of the at least two ridges comprising first portions that direct sound away from the plurality of openings in the corresponding downstream second portions.

15. The vehicle exhaust system of claim 14, wherein each of the first portion and the second portion is curved along the central axis.

16. The vehicle exhaust system of claim 14, wherein each of the first portion and the second position is straight along the central axis.

17. The vehicle exhaust system of claim 14, wherein each opening has an area of at least 3.14 $mm^2$.

18. A vehicle exhaust system comprising:

a tubular component having an inner surface and an outer surface such that the inner surface defines a primary exhaust gas flow path, wherein the tubular component extends along a central axis from an inlet end to an outlet end, the tubular component including at least two ridges extending at least partly along a circumference of the tubular component, each of the at least two ridges including:

a first portion angularly extending inwardly from the tubular component; and a second portion disposed downstream of the first portion, the second portion angularly extending inwardly from the tubular component;

wherein each of the second portions of the tubular component further defines a plurality of tube openings extending therethrough and disposed downstream of the corresponding first portions; and wherein each of the first portions direct sound away from the plurality of openings in the corresponding downstream second portions.

19. The vehicle exhaust system of claim 18, wherein each of the second portions defines a plurality of openings extending therethrough and spaced apart from each other.

20. The vehicle exhaust system of claim 18, wherein each of the second portions are adjacent to the corresponding first portions.

* * * * *